US009736601B2

(12) United States Patent
Kasic et al.

(10) Patent No.: US 9,736,601 B2
(45) Date of Patent: Aug. 15, 2017

(54) ADJUSTABLE MAGNETIC SYSTEMS, DEVICES, COMPONENTS AND METHODS FOR BONE CONDUCTION HEARING AIDS

(71) Applicant: Sophono, Inc., Boulder, CO (US)

(72) Inventors: James F. Kasic, Boulder, CO (US); Nicholas F. Pergola, Arvada, CA (US); Markus C. Haller, Gland (CH)

(73) Assignee: Sophono, Inc., Boulder, CO (US)

( * ) Notice: Subject to any disclaimer, the term of this patent is extended or adjusted under 35 U.S.C. 154(b) by 1195 days.

(21) Appl. No.: 13/649,934

(22) Filed: Oct. 11, 2012

(65) Prior Publication Data

US 2014/0121449 A1 May 1, 2014

Related U.S. Application Data

(63) Continuation-in-part of application No. 13/550,581, filed on Jul. 16, 2012, now abandoned.

(51) Int. Cl.
*H04R 25/00* (2006.01)
*H04R 3/00* (2006.01)

(52) U.S. Cl.
CPC ..... *H04R 25/606* (2013.01); *H04R 3/002* (2013.01); *H04R 2460/13* (2013.01)

(58) Field of Classification Search
CPC ..... H04R 25/00; H04R 25/60; H04R 25/602; H04R 25/604; H04R 25/606; H04R 25/608; H04R 25/554; H04R 25/658; A61N 1/36032
See application file for complete search history.

(56) References Cited

U.S. PATENT DOCUMENTS

| | | | | |
|---|---|---|---|---|
| 4,352,960 | A | 10/1982 | Dormer et al. | |
| 4,612,915 | A | 9/1986 | Hough et al. | |
| 4,726,378 | A | 2/1988 | Kaplan | |
| 4,736,747 | A | 4/1988 | Drake | |
| RE32,947 | E | 6/1989 | Dormer | |
| 4,918,745 | A | 4/1990 | Hutchison | |
| 5,558,618 | A | 9/1996 | Maniglia | |
| 5,906,635 | A | 5/1999 | Maniglia | |
| 6,178,353 | B1 * | 1/2001 | Griffith et al. | 607/61 |
| 6,246,911 | B1 | 6/2001 | Seligman | |

(Continued)

FOREIGN PATENT DOCUMENTS

| | | |
|---|---|---|
| DE | 202009003508 U1 | 7/2009 |
| DE | 202009005475 | 7/2009 |

(Continued)

OTHER PUBLICATIONS

"A Miniature Bone Vibrator for Hearing Aids and Similar Applications," BHM-Tech Produktiongesellschaft m.b.H, Austria, 2004, Technical Data VKH3391W.

(Continued)

*Primary Examiner* — Charles A Marmor, II
*Assistant Examiner* — Carrie R Dorna
(74) *Attorney, Agent, or Firm* — Jeffrey Hohenshell

(57) ABSTRACT

Various embodiments of systems, devices, components, and methods are disclosed for adjustable bone conduction hearing aids where a patient or health care provided can select different positions of a magnetic spacer on a patient's skull after a magnetic implant has been implanted beneath the patient's skin and affixed to the patient's skull.

13 Claims, 17 Drawing Sheets

(56) References Cited

U.S. PATENT DOCUMENTS

| | | | |
|---|---|---|---|
| 6,358,281 | B1 | 3/2002 | Berrang et al. |
| 6,517,476 | B1 | 2/2003 | Bedoya et al. |
| 6,537,200 | B2 | 3/2003 | Leysieffer |
| 6,565,503 | B2 | 5/2003 | Leysieffer et al. |
| 6,648,914 | B2 | 11/2003 | Berrang et al. |
| 7,021,676 | B2 | 4/2006 | Westerkull |
| 7,065,223 | B2 | 6/2006 | Westerkull |
| 7,186,211 | B2 | 3/2007 | Schneider et al. |
| 7,386,143 | B2 | 6/2008 | Easter et al. |
| 7,599,508 | B1 | 10/2009 | Lynch |
| 7,856,986 | B2 | 12/2010 | Darley |
| 8,027,735 | B1 * | 9/2011 | Tziviskos ..... A61N 1/36032 607/57 |
| 8,107,661 | B1 | 1/2012 | Lynch |
| 8,170,253 | B1 | 5/2012 | Lynch |
| 8,255,058 | B2 | 8/2012 | Gibson et al. |
| 8,270,647 | B2 | 9/2012 | Crawford et al. |
| 8,315,705 | B2 | 11/2012 | Keuninckx |
| 8,369,959 | B2 | 2/2013 | Meskens |
| 8,406,443 | B2 | 3/2013 | Westerkull et al. |
| 8,452,412 | B2 | 5/2013 | Ibrahim |
| 8,509,461 | B2 | 8/2013 | Parker |
| 8,515,112 | B2 | 8/2013 | Crawford et al. |
| 8,538,545 | B2 | 9/2013 | Meskens |
| 8,774,930 | B2 | 7/2014 | Ball |
| 8,787,608 | B2 | 7/2014 | Van Himbeeck et al. |
| 8,811,643 | B2 | 8/2014 | Crawford et al. |
| 8,891,795 | B2 | 11/2014 | Andersson |
| 8,897,475 | B2 | 11/2014 | Ball |
| 8,897,883 | B2 | 11/2014 | Griffith |
| 8,923,968 | B2 | 12/2014 | Meskens |
| 8,934,984 | B2 | 1/2015 | Meskens et al. |
| 9,020,174 | B2 | 4/2015 | Asnes |
| 9,022,917 | B2 | 5/2015 | Kasic et al. |
| 9,031,274 | B2 | 5/2015 | Kasic, II |
| 9,119,010 | B2 | 8/2015 | Ruppersberg et al. |
| 2007/0053536 | A1 | 3/2007 | Westerkull |
| 2007/0274551 | A1 | 11/2007 | Tsai et al. |
| 2009/0248155 | A1 | 10/2009 | Parker |
| 2009/0299437 | A1 | 12/2009 | Zimmerling |
| 2010/0145135 | A1 | 6/2010 | Ball et al. |
| 2011/0022120 | A1 | 1/2011 | Ball et al. |
| 2011/0216927 | A1 | 9/2011 | Ball |
| 2012/0029267 | A1 | 2/2012 | Ball |
| 2012/0041515 | A1 | 2/2012 | Meskens et al. |
| 2012/0078035 | A1 | 3/2012 | Andersson et al. |
| 2012/0080039 | A1 | 4/2012 | Siegert |
| 2012/0088957 | A1 | 4/2012 | Adamson et al. |
| 2012/0238799 | A1 | 9/2012 | Ball et al. |
| 2012/0294466 | A1 | 11/2012 | Kristo et al. |
| 2012/0296155 | A1 | 11/2012 | Ball |
| 2012/0302823 | A1 | 11/2012 | Andersson et al. |
| 2013/0018218 | A1 | 1/2013 | Haller et al. |
| 2013/0046131 | A1 | 2/2013 | Ball et al. |
| 2013/0089229 | A1 | 4/2013 | Kristo et al. |
| 2013/0150657 | A1 | 6/2013 | Leigh et al. |
| 2013/0261377 | A1 | 10/2013 | Adamson et al. |
| 2013/0281764 | A1 | 10/2013 | Bjorn et al. |
| 2014/0064531 | A1 | 3/2014 | Andersson et al. |
| 2014/0121447 | A1 | 5/2014 | Kasic et al. |
| 2014/0121449 | A1 | 5/2014 | Kasic et al. |
| 2014/0121450 | A1 | 5/2014 | Kasic et al. |
| 2014/0121451 | A1 | 5/2014 | Kasic et al. |
| 2014/0121452 | A1 | 5/2014 | Kasic et al. |
| 2014/0153737 | A1 | 6/2014 | Geschiere |
| 2014/0163692 | A1 | 6/2014 | Van Den Heuvel et al. |
| 2014/0193011 | A1 | 7/2014 | Parker |
| 2014/0233765 | A1 | 8/2014 | Andersson et al. |
| 2014/0270293 | A1 | 9/2014 | Ruppersberg et al. |
| 2014/0275731 | A1 | 9/2014 | Andersson et al. |
| 2014/0275735 | A1 | 9/2014 | Ruppersberg et al. |
| 2014/0275736 | A1 | 9/2014 | Ruppersberg et al. |
| 2014/0336447 | A1 | 11/2014 | Bjorn et al. |
| 2015/0016649 | A1 | 1/2015 | Van Himbeeck et al. |
| 2015/0043766 | A1 | 2/2015 | Westerkull |
| 2015/0063616 | A1 | 3/2015 | Westerkull |
| 2015/0141740 | A1 | 5/2015 | Miller |
| 2015/0146902 | A1 | 5/2015 | Jinton et al. |
| 2015/0156594 | A1 | 6/2015 | Bervoets |
| 2015/0163579 | A1 | 6/2015 | Kristo et al. |

FOREIGN PATENT DOCUMENTS

| | | |
|---|---|---|
| WO | 2010/105601 | 9/2010 |
| WO | 2015/020753 A2 | 2/2015 |
| WO | 2015/034582 A2 | 3/2015 |

OTHER PUBLICATIONS

"Microphone 8010T", Data Sheet, RoHS, Sonion, Dec. 20, 2007.
"Inspiria Extreme Digital DSP System," Preliminary Data Sheet, Sound Design Technologies, Mar. 2009.
"Alpha 1 (S) & Alpha 1 (M) Bone Conduction Hearing Systems," Physician Manual, REV A S0371-00, Jul. 2012, pp. 1-49.

* cited by examiner

ALPHA 1

BAHA

AUDIANT
(PRIOR ART)
NS
DSP
MIC
BAT
BH
S
N
10
15
17
19
20
25
40
45
50
55
60
70
72
75
80
85
95
107
115

ADJUSTABLE MAGNETIC SYSTEMS, DEVICES, COMPONENTS AND METHODS FOR BONE CONDUCTION HEARING AIDS

RELATED APPLICATIONS

This application is a continuation-in-part of, and claims priority and other benefits from, U.S. patent application Ser. No. 13/550,581 entitled "Systems, Devices, Components and Methods for Bone Conduction Hearing Aids" to Pergola et al. filed Jul. 16, 2012 (hereafter "the '581 patent application"). The '581 patent application is hereby incorporated by reference herein, in its entirety.

This application also hereby incorporates by reference, each in its respective entirety, the following patent applications filed on even date herewith: (1) U.S. patent application Ser. No. 13/650,026 entitled "Magnetic Abutment Systems, Devices, Components and Methods for Bone Conduction Hearing Aids" to Kasic et al.; (2) U.S. patent application Ser. No. 13/650,057 entitled "Magnetic Spacer Systems, Devices, Components and Methods for Bone Conduction Hearing Aids" to Kasic et al., now U.S. Pat. No. 9,022,917, and (3) U.S. patent application Ser. No. 13/650,080 entitled "Abutment Attachment Systems, Mechanisms, Devices, Components and Methods for Bone Conduction Hearing Aids" to Kasic et al.

FIELD OF THE INVENTION

Various embodiments of the invention described herein relate to the field of systems, devices, components, and methods for bone conduction hearing aid devices.

BACKGROUND

A magnetic bone conduction hearing aid is held in position on a patient's head by means of magnetic attraction that occurs between magnetic members included in the hearing aid and magnetic members included in a magnetic implant that has been implanted beneath the patient's skin, and that has been affixed to the patient's skull. Typically, such hearing aids may be positioned on the patient's head in only one orientation in a single position or location only. If a patient's skin or tissue at such a single location is particularly thin or becomes irritated or inflamed while the magnetic hearing aid is being worn, or if the patent is uncomfortable or experiences discomfort or pain when wearing the hearing aid, then the only effective remedy for the pain or discomfort may be to remove the magnetic hearing aid from the patient's head, as somehow repositioning the magnetic hearing into a different location where good magnetic coupling can still be achieved and wearer comfort can be achieved is not an available option.

What is needed is a magnetic hearing aid and corresponding magnetic implant that permit a hearing aid to be located in different positions on a patient's head.

SUMMARY

In one embodiment, there is provided an adjustable magnetic hearing system comprising an electromagnetic ("EM") transducer, a magnetic spacer comprising at least first and second magnetic members, the magnetic spacer being configured to be mechanically and acoustically coupled to the EM transducer, and a magnetic implant comprising at least third, fourth and fifth magnetic members, the magnetic implant being configured for implantation beneath a patient's skin and affixation to the patient's skull, wherein the magnetic implant and the magnetic spacer are further configured such that the patient or a healthcare provider may selectively position the magnetic spacer in at least a first position or a second position with respect to the magnetic implant after the magnetic implant has been implanted in the patient, the first position is different from the second position, the first and second magnetic members may be magnetically coupled to the third and fourth magnetic members when in the first position such that the magnetic spacer is operably held in the first position against the patient's skin, and the first and second magnetic members may be magnetically coupled to the fourth and fifth magnetic members when in the second position such that the magnetic spacer is operably held in the second position against the patient's skin.

In another embodiment, there is provided a magnetic implant for use in conjunction with an adjustable magnetic hearing device comprising an electromagnetic ("EM") transducer and a magnetic spacer comprising at least first and second magnetic members, the magnetic spacer being configured to be mechanically and acoustically coupled to the EM transducer, wherein the magnetic implant comprises at least third, fourth and fifth magnetic members, the magnetic implant is configured for implantation beneath a patient's skin and affixation to the patient's skull, the magnetic implant is configured such that the patient or a healthcare provider may selectively position the magnetic spacer in at least a first position or a second position with respect to the magnetic implant after the magnetic implant has been implanted in the patient, and further wherein the first position is different from the second position, the first and second magnetic members may be magnetically coupled to the third and fourth magnetic members when in the first position such that the magnetic spacer is operably held in the first position against the patient's skin, and the first and second magnetic members may be magnetically coupled to the fourth and fifth magnetic members when in the second position such that the magnetic spacer is operably held in the second position against the patient's skin.

In yet another embodiment, there is provided a method of adjusting a position of a magnetic hearing device on a patient's head with respect to a magnetic implant comprising at least third, fourth and fifth magnetic members implanted beneath a patient's skin and affixed to the patient's skull, the device comprising an electromagnetic ("EM") transducer and a magnetic spacer comprising at least first and second magnetic members, the magnetic spacer being configured to be mechanically and acoustically coupled to the EM transducer, the method comprising a patient or healthcare provider selectively positioning the magnetic spacer in a first position or in a second position with respect to the magnetic implant after the magnetic implant has been implanted in the patient, wherein the first position is different from the second position, the first and second magnetic members may be magnetically coupled to the third and fourth magnetic members when in the first position such that the magnetic spacer is operably held in the first position against the patient's skin, and the first and second magnetic members may be magnetically coupled to the fourth and fifth magnetic members when in the second position such that the magnetic spacer is operably held in the second position against the patient's skin.

In still another embodiment, there is provided an adjustable magnetic hearing system comprising an electromagnetic ("EM") transducer, a magnetic spacer comprising at least first, second and third magnetic members, the magnetic spacer being configured to be mechanically and acoustically coupled to the EM transducer, and a magnetic implant comprising fourth and fifth magnetic members, the magnetic implant being configured for implantation beneath a patient's skin and affixation to the patient's skull, wherein the magnetic implant and the magnetic spacer are further configured such that the patient or a healthcare provider may selectively position the magnetic spacer in at least a first position or a second position with respect to the magnetic implant after the magnetic implant has been implanted in the patient, the first position is different from the second position, the first and second magnetic members may be magnetically coupled to the fourth and fifth magnetic members when in the first position such that the magnetic spacer is operably held in the first position against the patient's skin, and the second and third magnetic members may be magnetically coupled to the fourth and fifth magnetic members when in the second position such that the magnetic spacer is operably held in the second position against the patient's skin.

In a further embodiment, there is provided a method of adjusting a position of a magnetic hearing device on a patient's head with respect to a magnetic implant comprising at fourth and fifth magnetic members implanted beneath a patient's skin and affixed to the patient's skull, the device comprising an electromagnetic ("EM") transducer and a magnetic spacer comprising at least first, second and third magnetic members, the magnetic spacer being configured to be mechanically and acoustically coupled to the EM transducer, the method comprising a patient or healthcare provider selectively positioning the magnetic spacer in a first position or in a second position with respect to the magnetic implant after the magnetic implant has been implanted in the patient, wherein the first position is different from the second position, the first and second magnetic members may be magnetically coupled to the fourth and fifth magnetic members when in the first position such that the magnetic spacer is operably held in the first position against the patient's skin, and the second and third magnetic members may be magnetically coupled to the fourth and fifth magnetic members when in the second position such that the magnetic spacer is operably held in the second position against the patient's skin.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO® ALPHA 1® hearing aid 10;

FIG. 3(*c*) shows one embodiment of hearing aid 10 having a single magnetic member 55*a* disposed in magnetic spacer 50 thereof;

FIGS. 4(*c*) and 4(*d*) show another embodiment of magnetic implant 20 and corresponding magnetic spacer 50;

FIGS. 5(*d*) through 5(*f*) show still other embodiments of magnetic implant 20 and corresponding magnetic spacers 50;

FIGS. 6(*d*) through 6(*f*) show yet further embodiments of magnetic implant 20 and corresponding magnetic spacers 50;

FIGS. 7(*e*) through 7(*h*) show more embodiments of magnetic implant 20 and corresponding magnetic spacers 50;

FIGS. 8(*d*) through 8(*f*) show yet further embodiments of magnetic implant 20 and corresponding magnetic spacers 50;

FIG. 9(*b*) shows a top plan view of magnetic implant 20 shown in FIG. 9(*a*);

FIGS. 10(*b*) and 10(*c*) show two different embodiments of side cross-sectional views of magnetic implant 20 of FIG. 10(*a*) affixed to skull 75 of a patient, and FIGS. 11(*a*) and 11(*b*) show two different views of one embodiment of a force-spreading or force-distributing additional spacer 150 configured for use with magnetic spacer 50.

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OPTICON™ of Smoerum, Sweden. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by SOPHONO™ of Boulder, Colo., the entirety of which is hereby incorporated by reference herein.

Figures 1A, 1B, 1C:
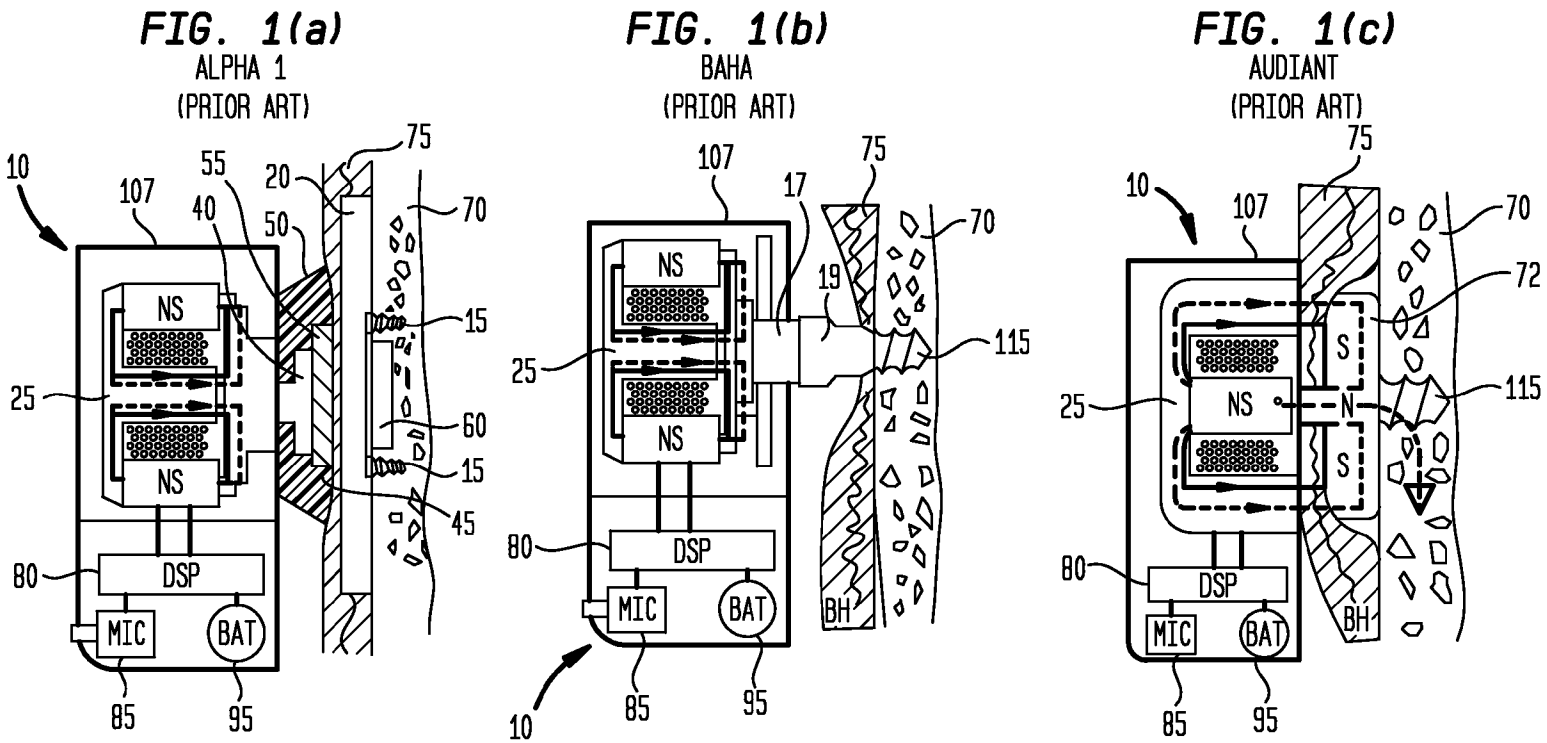
(PRIOR ART) FIG. 1(b)
(PRIOR ART) FIG. 1(c)
FIGS. 1(*a*), 1(*b*) and 1(*c*) show side cross-sectional schematic views of selected embodiments of prior art SOPHONO ALPHA 1, BAHA and AUDIANT bone conduction hearing aids, respectively.

FIGS. 1(*a*), 1(*b*) and 1(*c*) show side cross-sectional schematic views of selected embodiments of prior art SOPHONO ALPHA 1, BAHA and AUDIANT bone conduction hearing aids, respectively. Note that FIGS. 1(*a*), 1(*b*) and 1(*c*) are not necessarily to scale.

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer 50, magnetic implant or magnetic implant bone plate 20. As shown in FIGS. 1(*a*) and 2(*a*), and according to one embodiment, magnetic implant 20 comprises a frame 21 (see FIG. 3(*a*)) formed of a biocompatible metal such as medical grade titanium that is configured to have disposed therein or have attached thereto implantable magnets or magnetic members 60. Bone screws 15 secure or affix magnetic implant 20 to skull 70, and are disposed through screw holes 22 of frame 21 (see FIG. 2(*a*)). Magnetic members 60 are configured to couple magnetically to one or more corresponding external magnetic members or magnets 55 mounted onto or into, or otherwise forming a portion of, magnetic spacer 50, which in turn is operably coupled to EM transducer 25 and metal disc 40. DSP 80 is configured to drive EM transducer 25, metal disk 40 and magnetic spacer 50 in accordance with external audio signals picked up by microphone 85. DSP 80 and EM transducer 25 are powered by battery 95, which according to one embodiment may be a zinc-air battery, or may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer 50 by patient's skin 75. Hearing aid device 10 of FIG. 1(*a*) is thereby operably coupled magnetically and mechanically to plate 20 implanted in patient's skull 70, which permits the transmission of audio signals originating in DSP 80 and EM transducer 25 to the patient's inner ear via skull 70.

FIG. 1(*b*) shows another embodiment of hearing aid 10, which is a BAHA® device comprising housing 107, EM transducer 25 with corresponding magnets and coils, DSP 80, battery 95, external post 17, internal bone anchor 115, and abutment member 19. In one embodiment, and as shown in FIG. 1(*b*), internal bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals picked up by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means. Hearing aid device 10 of FIG. 1(*b*) is thus coupled magnetically and/or mechanically to bone anchor 115 implanted in patient's skull 70, thereby permitting the transmission of audio signals originating in DSP 80 and EM transducer 25 to the patient's inner ear via skull 70.

FIG. 1(*c*) shows another embodiment of hearing aid 10, which is an AUDIANT®-type device, where an implantable magnetic member 72 is attached by means of bone anchor 115 to patient's skull 70. Internal bone anchor 115 includes a bone screw formed of a biocompatible metal such as titanium, and has disposed thereon or attached thereto implantable magnetic member 72, which couples magnetically through patient's skin 75 to EM transducer 25. DSP 80 is configured to drive EM transducer 25 in accordance with external audio signals picked up by microphone 85. Hearing aid device 10 of FIG. 1(*c*) is thus coupled magnetically to bone anchor 15 implanted in patient's skull 70, thereby permitting the transmission of audio signals originating in DSP 80 and EM transducer 25 to the patient's inner ear via skull 70.

Figure 2A:
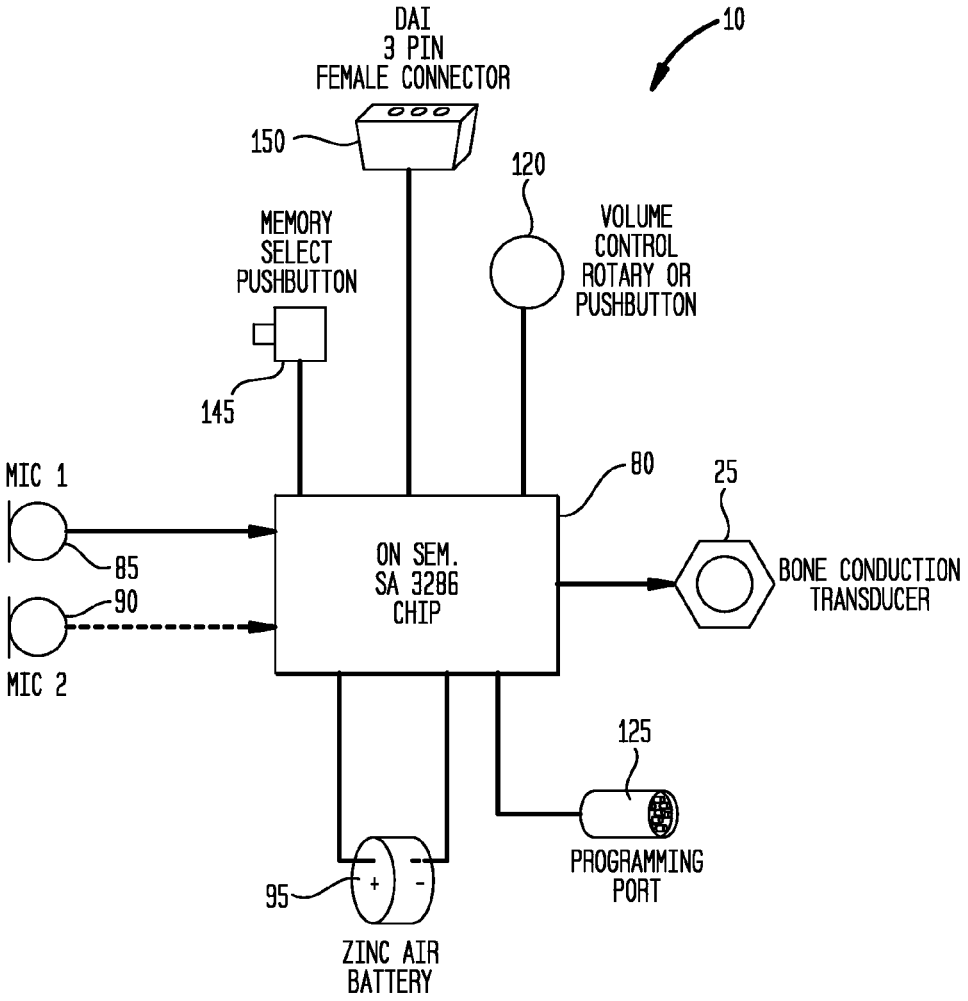
FIG. 2(a) (PRIOR ART)
FIG. 2(*a*) shows one embodiment of a prior art functional electronic and electrical block diagram of hearing aid 10 shown in FIGS. 1(*a*) and 3(*b*)
Figure 2B:
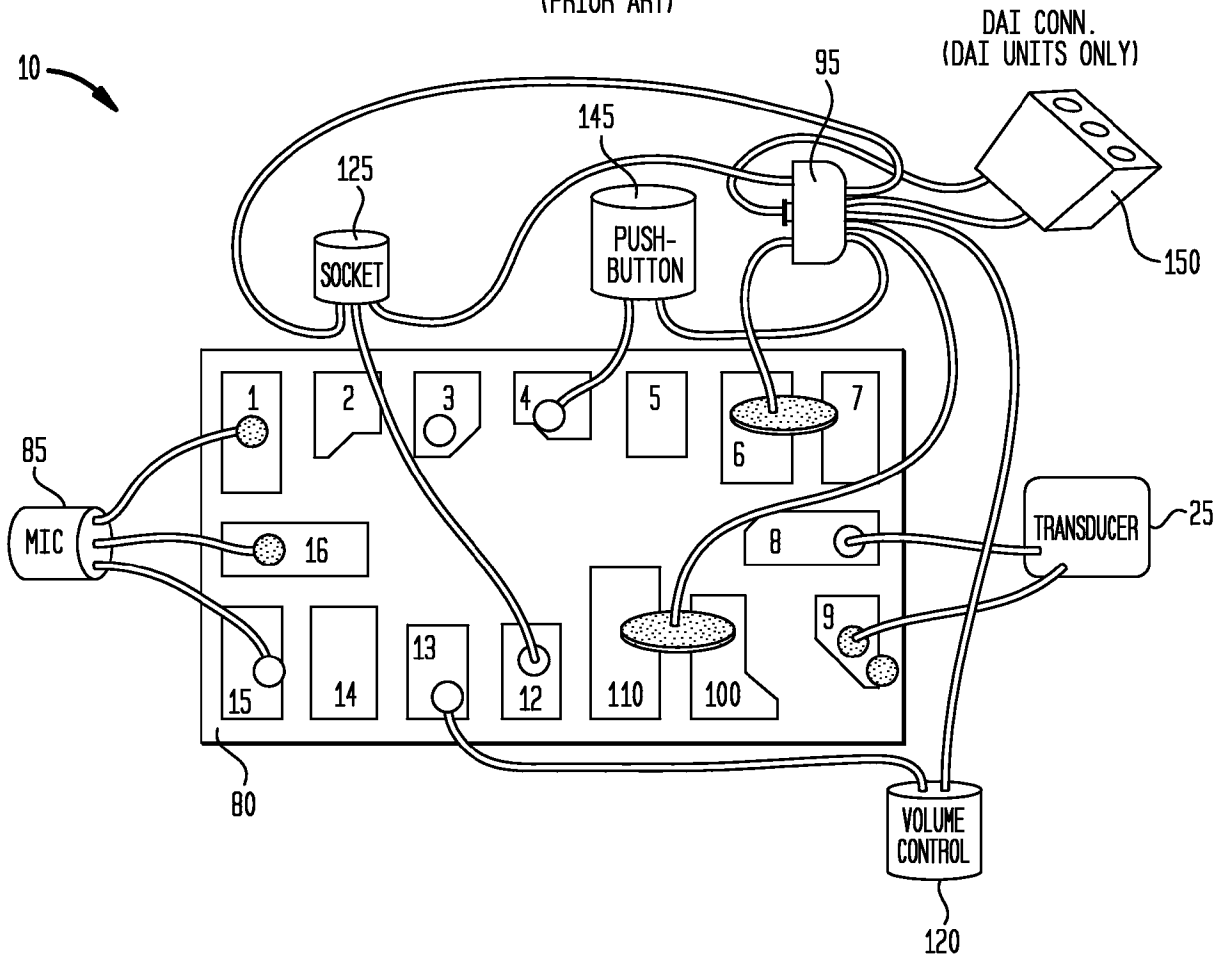
FIG. 2(b) (PRIOR ART)

FIG. 2(*a*) shows one embodiment of a prior art functional electronic and electrical block diagram of hearing aid 10 shown in FIGS. 1(*a*) and 2(*b*). In the block diagram of FIG. 2(*a*), and according to one embodiment, DSP 80 is a SOUND DESIGN TECHNOLOGIES® SA3286 INSPIRA EXTREME® DIGITAL DSP, for which data sheet 48550-2 dated March 2009, filed on even date herewith in an accompanying Information Disclosure Statement ("IDS"), is hereby incorporated by reference herein in its entirety. The audio processor for the SOPHONO ALPHA 1 hearing aid is centered around DSP chip 80, which provides programmable signal processing. The signal processing may be customized by computer software which communicates with the Alpha through programming port 125. According to one embodiment, the system is powered by a standard zinc air battery 95 (i.e. hearing aid battery), although other types of batteries may be employed. The SOPHONO ALPHA 1 hearing aid detects acoustic signals using a miniature microphone 85. A second microphone 90 may also be employed, as shown in FIG. 2(*a*). The SA 3286 chip supports directional audio processing with second microphone 90 to enable directional processing. Direct Audio Input (DAI) connector 150 allows connection of accessories which provide an audio signal in addition to or in lieu of the microphone signal. The most common usage of the DAI connector is FM systems. The FM receiver may be plugged into DAI connector 150. Such an FM transmitter can be worn, for example, by a teacher in a classroom to ensure the teacher is heard clearly by a student wearing hearing aid 10. Other DAI accessories include an adapter for a music player, a telecoil, or a Bluetooth phone accessory. According to one embodiment, DSP 80 or SA 3286 has 4 available program memories, allowing a hearing health professional to customize each of 4 programs for different listening situations.

The Memory Select Pushbutton 145 allows the user to choose from the activated memories. This might include special frequency adjustments for noisy situations, or a program which is Directional, or a program which uses the DAI input.

FIG. 2(*b*) shows one embodiment of a prior art wiring diagram for a SOPHONO ALPHA 1 hearing aid manufactured using the foregoing SA3286 DSP. Note that the various embodiments of hearing aid 10 are not limited to the use of a SA3286 DSP, and that any other suitable CPU, processor, controller or computing device may be used. According to one embodiment, DSP 80 is mounted on a printed circuit board 155 disposed within housing 110 and/or housing 115 of hearing aid 10 (not shown in the Figures).

In some embodiments, the microphone incorporated into hearing aid 10 is an 8010T microphone manufactured by SONION®, for which data sheet 3800-3016007, Version 1 dated December, 2007, filed on even date herewith in the accompanying IDS, is hereby incorporated by reference herein in its entirety. Other suitable types of microphones, including other types of capacitive microphones, may be employed.

In still further embodiments, the electromagnetic transducer 25 incorporated into hearing aid 10 is a VKH3391W transducer manufactured by BMH-Tech® of Austria, for which the data sheet filed on even date herewith in the accompanying IDS is hereby incorporated by reference herein in its entirety. Other types of suitable EM transducers may also be used.

Figure 3C:
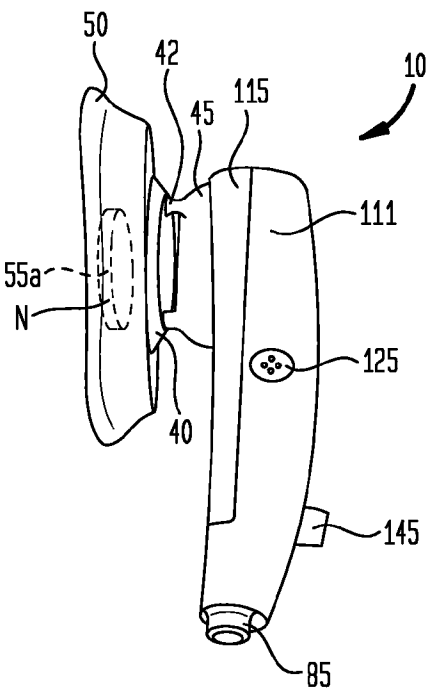
FIG. 3(*a*) shows one embodiment of prior art magnetic implant 20 according to FIG. 1(*a*), and various positions that overlying magnetic spacer 50 may assume in respect thereof.
Figure 3B:
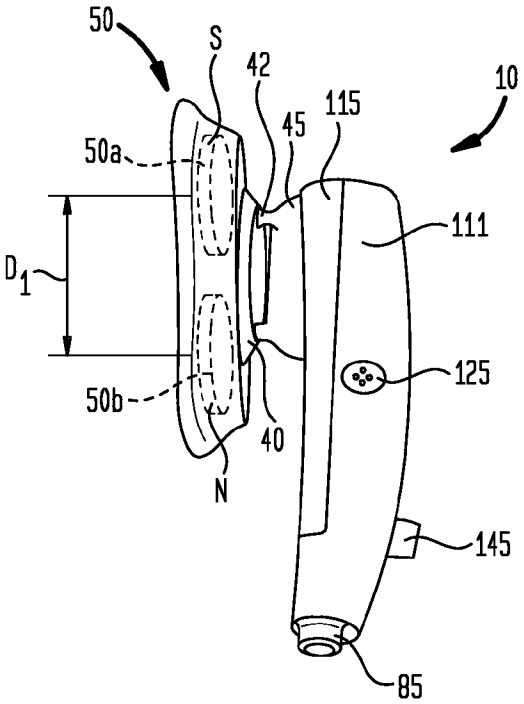
FIG. 3(b) (PRIOR ART)
Figure 3A:
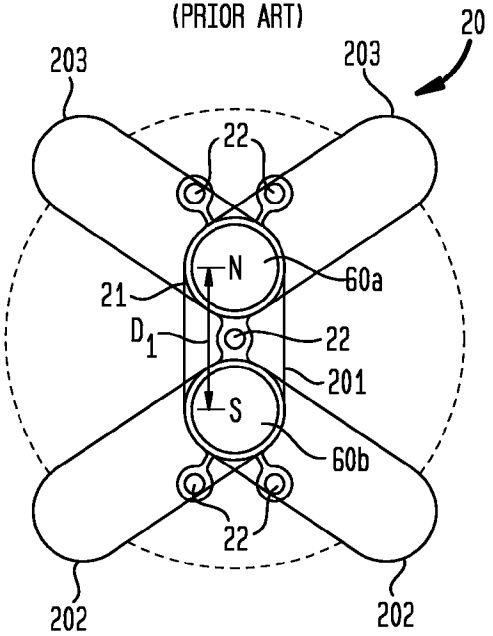
FIG. 3(a) (PRIOR ART)
Figure 4A:
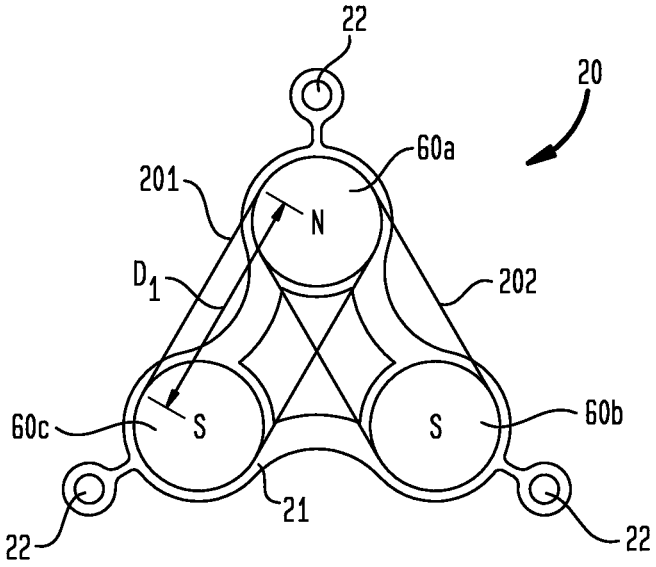
FIGS. 4(*a*) and 4(*b*) show one embodiment of magnetic implant 20 and corresponding magnetic spacer 50.
Figure 4B:
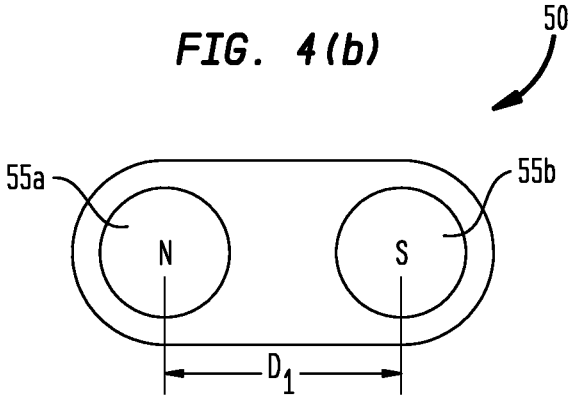
Figure 4C:
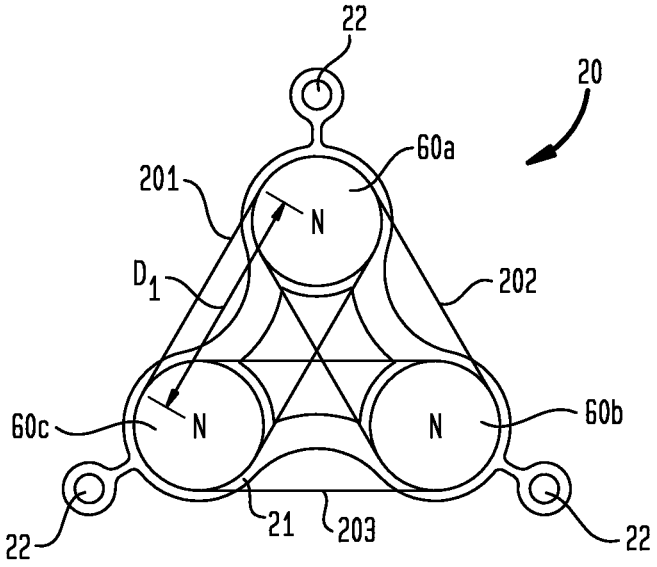
Figure 4D:
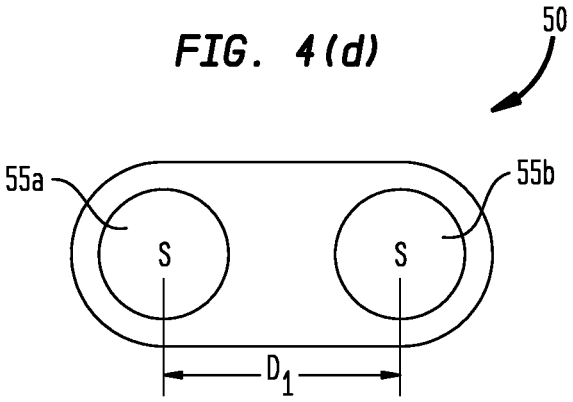
Figure 5A:
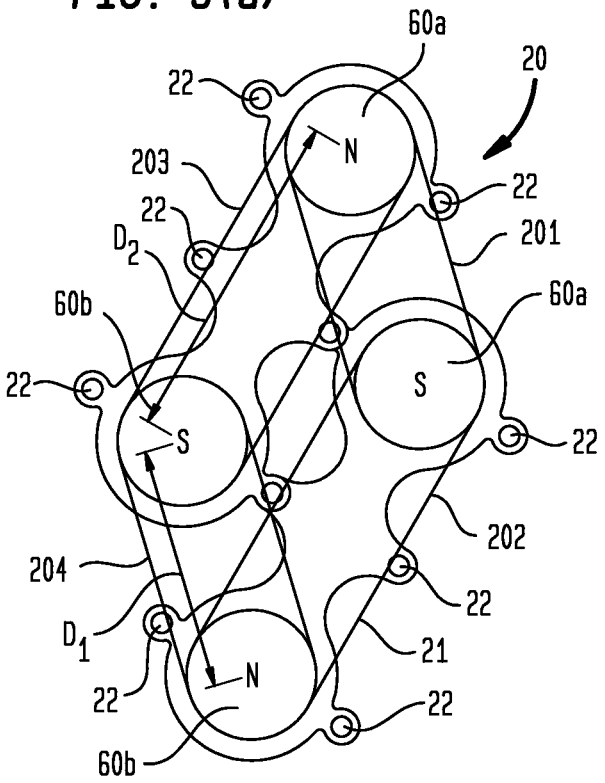
FIGS. 5(*a*) through 5(*c*) show yet other embodiments of magnetic implant 20 and corresponding magnetic spacers 50.
Figure 5B:
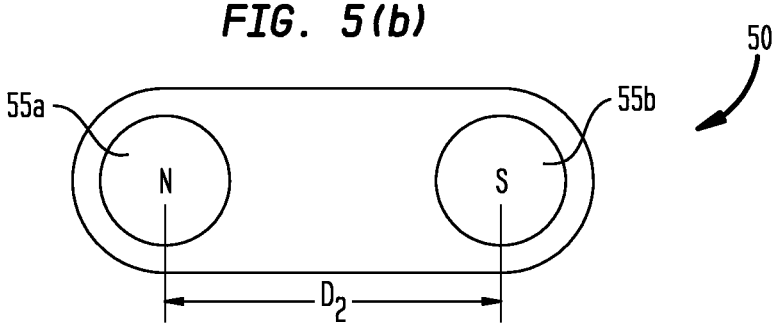
Figure 5C:
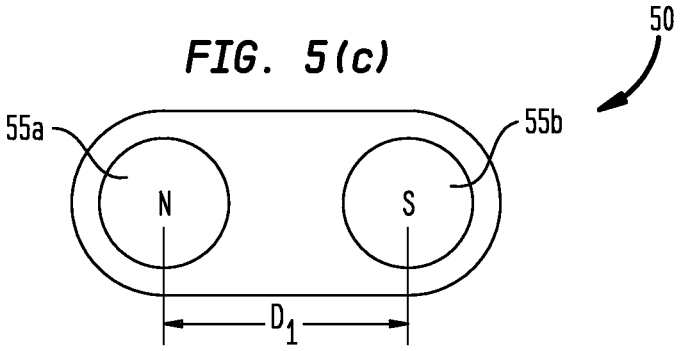
Figure 5D:
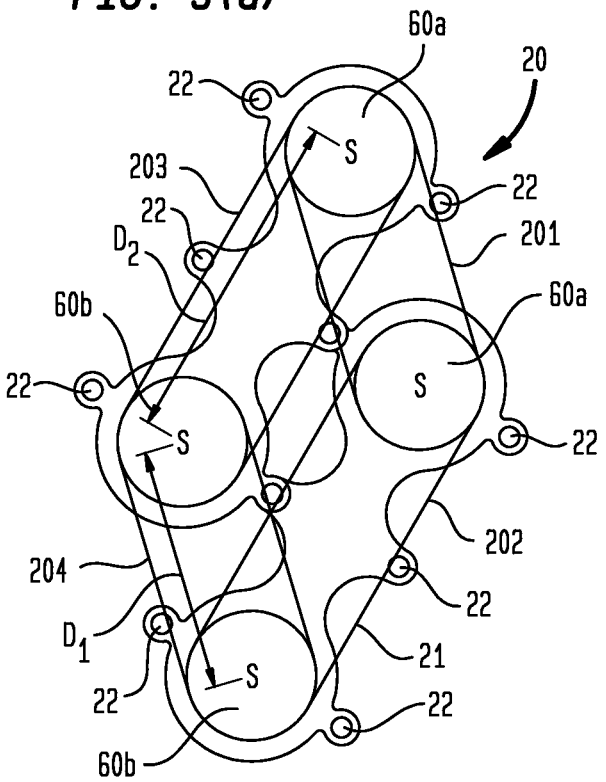
Figure 5E:
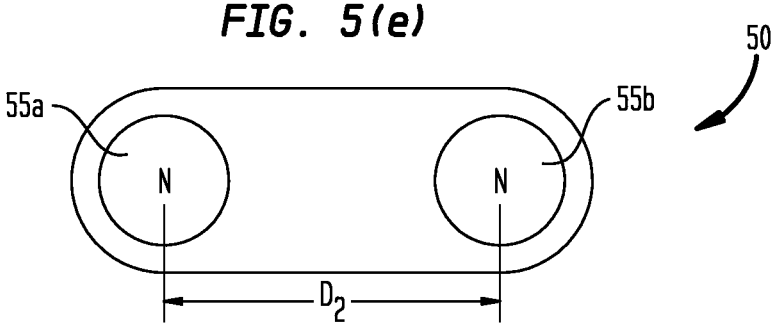
Figure 5F:
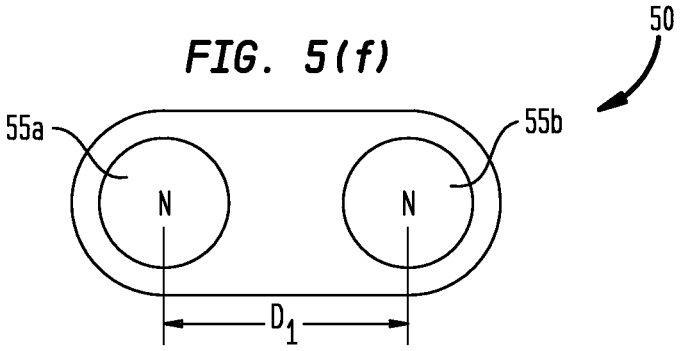
Figure 6A:
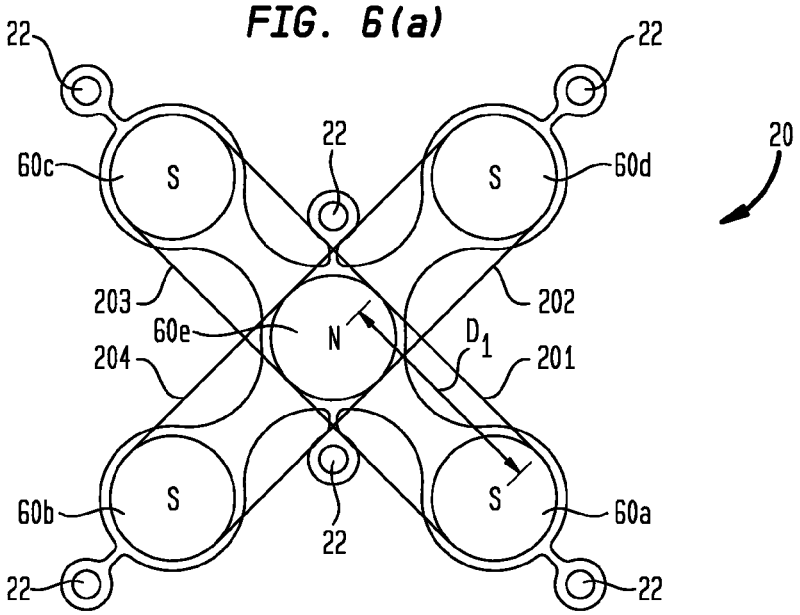
FIGS. 6(*a*) through 6(*c*) show further embodiments of magnetic implant 20 and corresponding magnetic spacers 50.
Figure 6B:
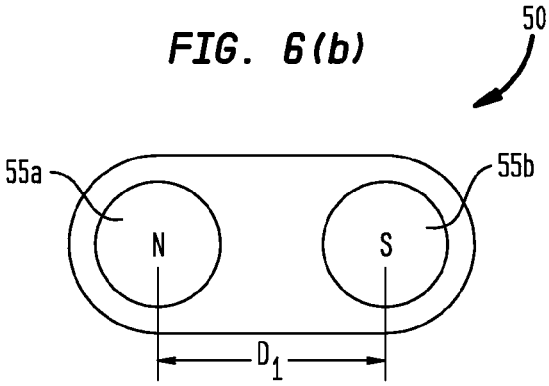
Figure 6C:
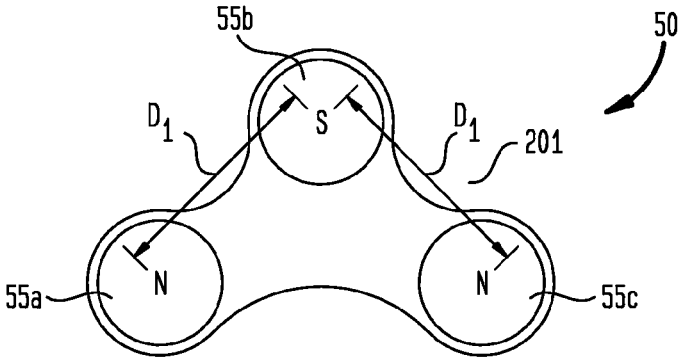
Figure 6D:
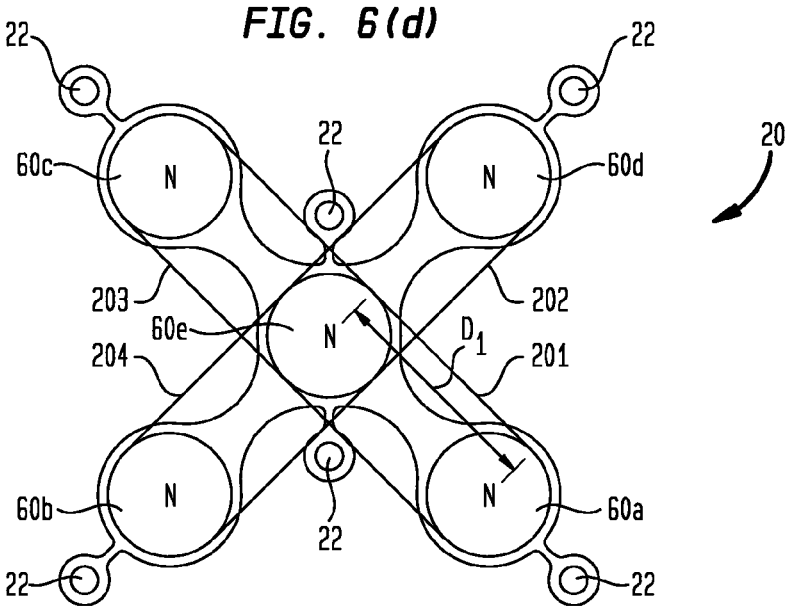
Figure 6E:
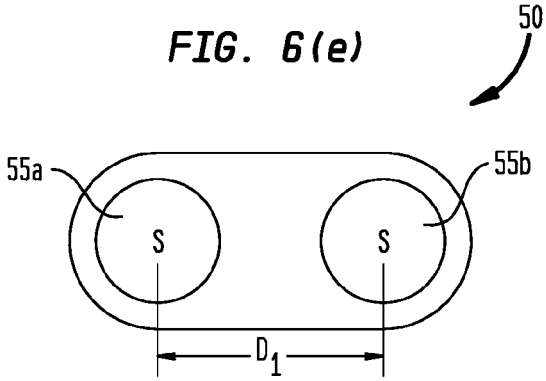
Figure 6F:
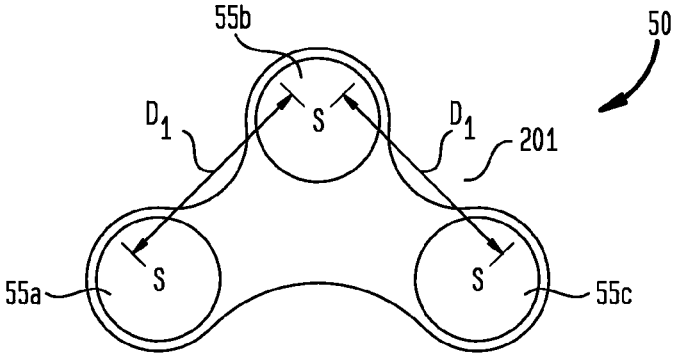
Figure 7A:
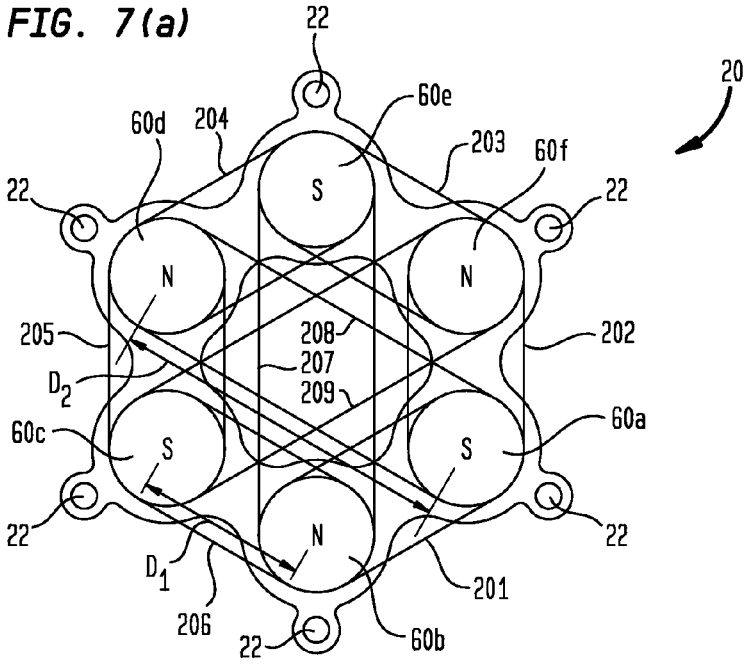
FIGS. 7(*a*) through 7(*d*) show additional embodiments of magnetic implant 20 and corresponding magnetic spacers 50.
Figure 7B:
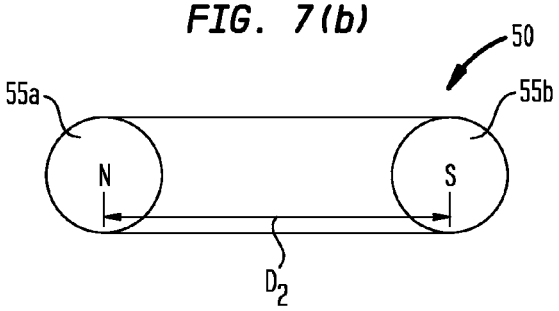
Figure 7C:
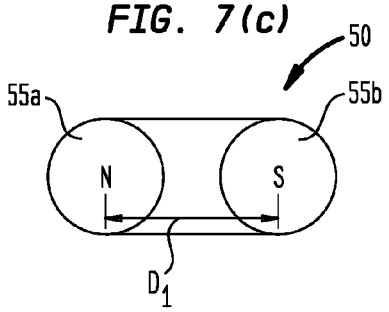
Figure 7D:
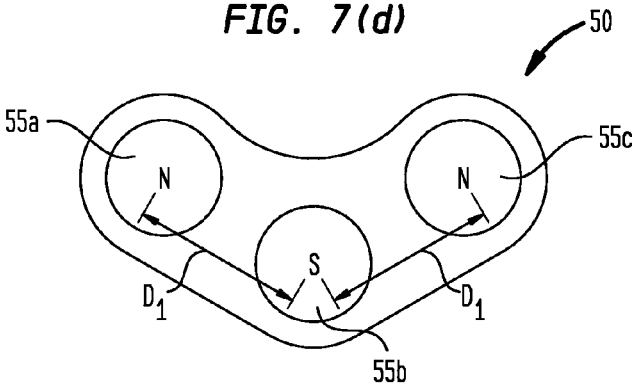
Figure 7E:
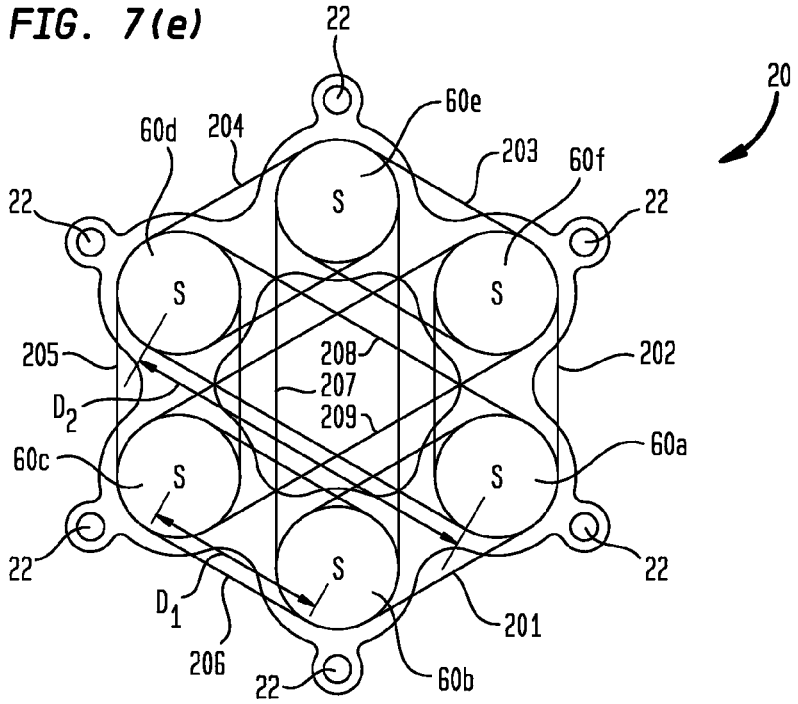
Figure 7F:
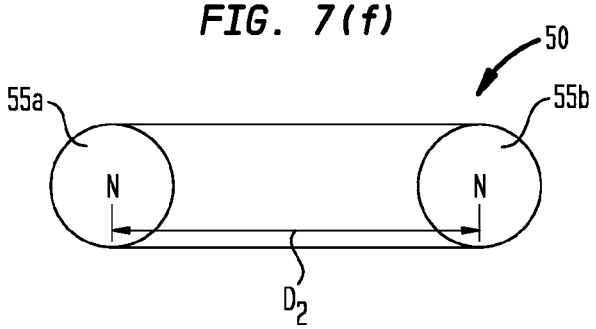
Figure 7G:
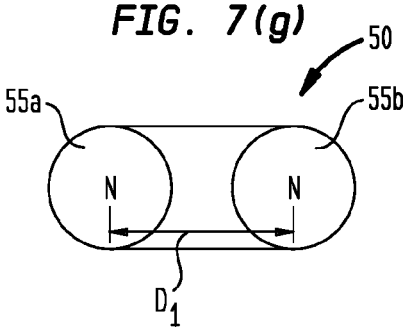
Figure 7H:
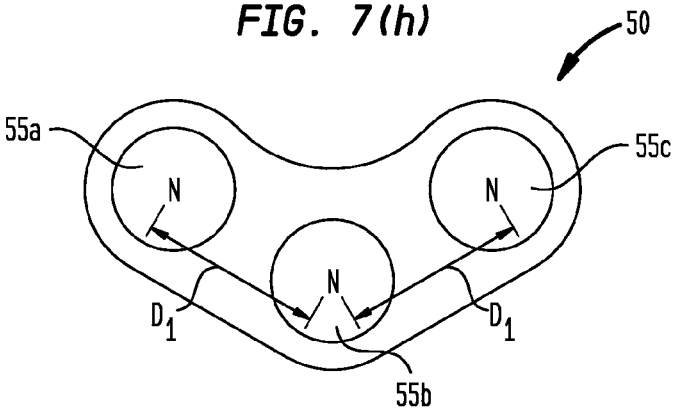
Figure 8A:
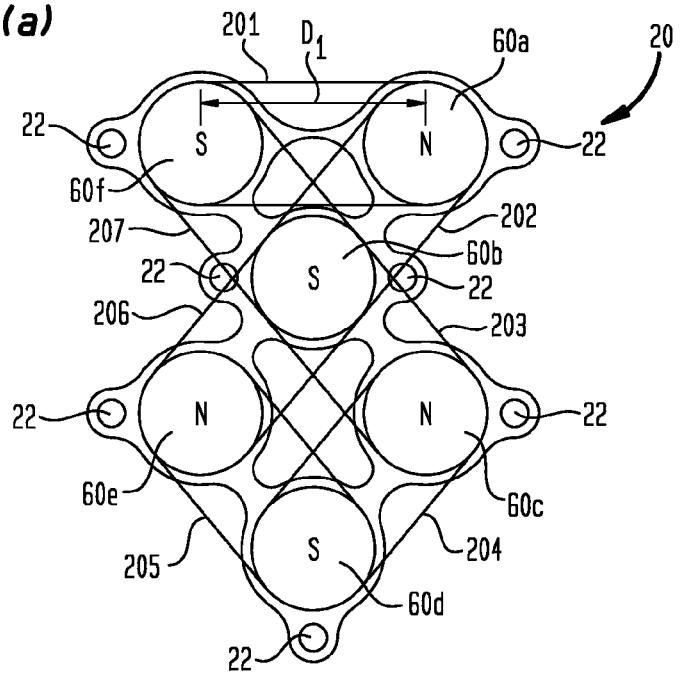
FIGS. 8(*a*) through 8(*c*) show further embodiments of magnetic implant 20 and corresponding magnetic spacers 50.
Figure 8B:
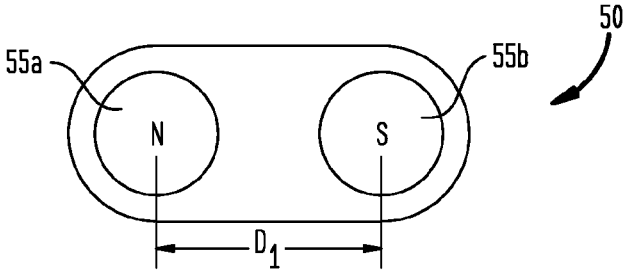
Figure 8C:
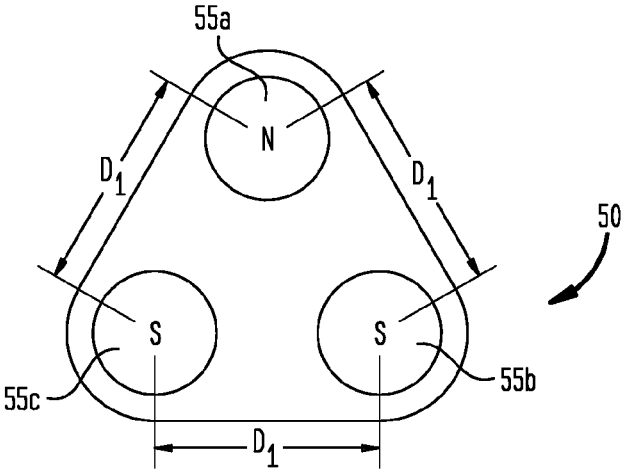
Figure 8D:
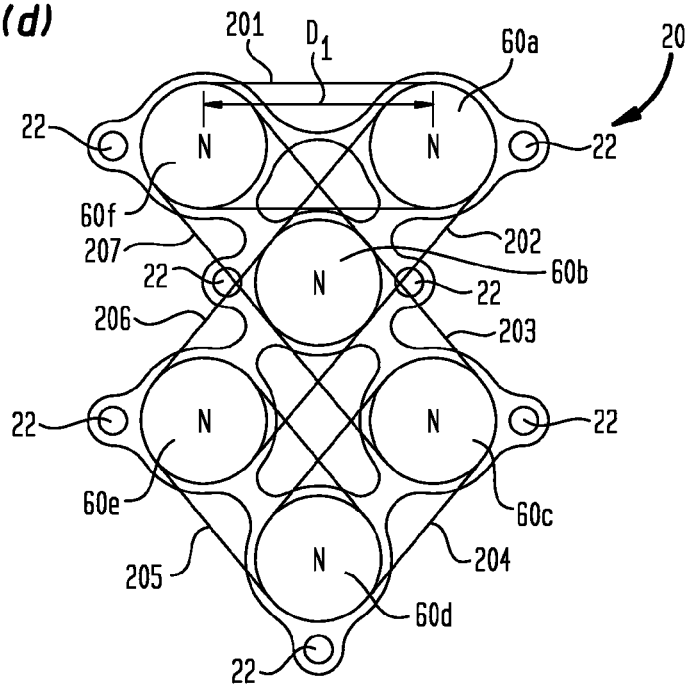
Figure 8E:
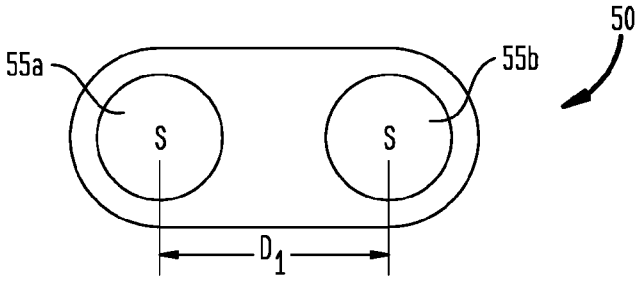
Figure 8F:
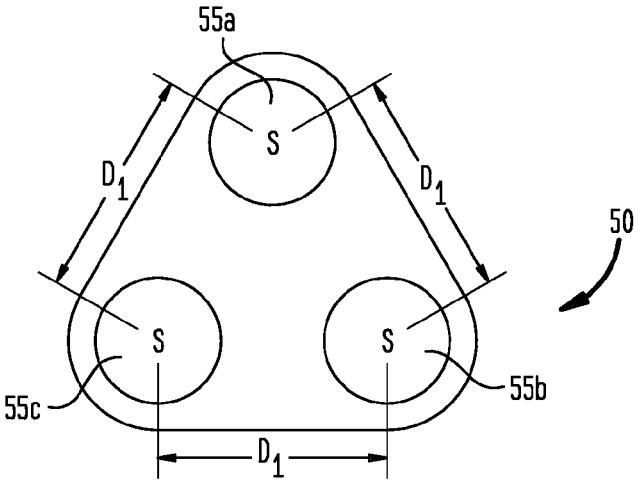

FIGS. 3(*a*) and 3(*b*) show implantable bone plate or magnetic implant 20 in accordance with FIG. 1(*a*), where frame 22 has disposed thereon or therein magnetic members 60*a* and 60*b*, and where magnetic spacer 50 of hearing aid 10 has magnetic members 55*a* and 55*b* spacer disposed therein. The two magnets 60*a* and 60*b* of magnetic implant 20 of FIG. 2(*a*) permit hearing aid 10 and magnetic spacer 50 to be placed in a single position on patient's skull 70, with respective opposing north and south poles of magnetic members 55*a*, 60*a*, 55*b* and 60*b* appropriately aligned with respect to one another to permit a sufficient degree of magnetic coupling to be achieved between magnetic spacer 50 and magnetic implant 20 (see also FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15. Other means of attachment known to those skilled in the art are also contemplated, however, such as glue, epoxy, and sutures.

Referring now to FIG. 3(*b*), there is shown a SOPHONO® ALPHA 1® hearing aid 10 configured to operate in accordance with magnetic implant 20 of FIG. 3(*a*). As shown, hearing aid 10 of FIG. 3(*b*) comprises upper housing 111, lower housing 115, magnetic spacer 50, external magnets 55*a* and 55*b* disposed within spacer 50, EM transducer diaphragm 45, metal disk 40 connecting EM transducer 25 to spacer 50, programming port/socket 125, program switch 145, and microphone 85. Not shown in FIG. 3(*b*) are other aspects of the embodiment of hearing aid 10, such as volume control 120, battery compartment 130, battery door 135, battery contacts 140, direct audio input (DAI) 150, and hearing aid circuit board 155 upon which various components are mounted, such as DSP 80.

Continuing to refer to FIGS. 3(*a*) and 3(*b*), frame 22 of magnetic implant 20 holds a pair of magnets 60*a* and 60*b* that correspond to magnets 55*a* and 55*b* included in spacer 50 shown in FIG. 3(*b*). The south (S) pole and north (N) poles of magnets 55*a* and 55*b*, are respectively configured in spacer 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing aid 10 onto a patient's head to be spread out or dispersed over a relatively wide surface area of the patient's hair and/or skin 75, and thereby prevent irritation of soreness that might otherwise occur if such magnetic forces were spread out over a smaller or more narrow surface area.

FIG. 3(*c*) shows hearing aid 10 having a single magnet 55*a* that could be used in conjunction with a magnetic implant 20 having only a single corresponding magnet 60*a*, and where the magnetic forces described above would be spread out over an even smaller surface area of the patient's hair or skin 75 than that associated with the embodiments shown in FIGS. 3(*a*) and 3(*b*). From the standpoint of reducing or minimizing patient soreness or irritation, however, the embodiment of spacer 50 shown in FIG. 3(*c*) might be even more undesirable than the embodiments shown in FIGS. 3(*a*) and 3(*b*) (subject, of course, to how such a single magnet design might be implemented, more about which is said below).

Referring now to FIG. 3(*b*), and during use or wearing of hearing aid 10 thereof and positioning of same over magnetic implant 20, it has been discovered that patients or health care providers sometimes place only one of the magnets of spacer 50 over only one of the magnets of magnetic implant 20, resulting in the positions of spacer 50 denoted by ovals 202 and 203 shown in FIG. 3(*a*). Such positions 202 and 203 have been discovered to provide substandard magnetic coupling of spacer 50 to magnetic implant 20, and also to increase the probability of hearing aid 10 causing a patient to experience undesired soreness or irritation. As a result, patients and health care providers may be specifically advised to avoid positions such as 202 and 203 of FIG. 3(*a*) when magnetically coupling hearing aid 10 to magnetic implant 20.

In FIGS. 3(*a*) and 3(*b*), and as mentioned above, the magnetic hearing aid design illustrated in such Figures permits the patient or health care provide to place spacer 50 in one position only over patient's skin 54. It has been discovered that despite the magnetic-force-spreading intent of the design illustrated in FIGS. 3(*a*) and 3(*b*), skin soreness and irritation may still occur in some patients. What is needed is a spacer 50 and corresponding magnetic implant 20 that permit hearing aid 10 to adopt multiple and different selectable positions on patient's skull 70, and that still provide the required amount of magnetic force and coupling to hold hearing aid 10 on patient's skull 70 during actual use.

Referring now to FIGS. 4(*a*) through 4(*d*), there are shown various embodiments of magnetic implants 20 and magnetic spacers 50 that are configured to permit multiple different positions of spacer 50 (and hearing aid 10 attached thereto) to be selected by the patient or a health care provider on a patient's skull 70.

In FIGS. 4(*a*) and 4(*b*), there is shown one embodiment of magnetic implant 20 and corresponding magnetic spacer 50, where both north and south magnetic poles are employed in magnetic members 60*a* (north pole), 60*b* (south pole), and 60*c* (south pole) of magnetic implant 20, and where both north and south magnetic poles are employed in magnetic members 55*a* (north pole) and 55*b* (south pole) of magnetic spacer 50. Such a configuration permits magnetic spacer 50 of FIG. 4(*b*) to assume position 201 or position 202 with respect to magnetic implant 20 of FIG. 4(*a*). After magnetic implant 20 has been implanted beneath patient's skin 75 and affixed to skull 70, the patient or health care provider can position magnetic spacer 50 in either position 201 or 202 by merely lifting magnetic spacer away from patient's skull 70 and repositioning magnetic spacer 50 in the desired different position (i.e., position 201 from position 202, or position 202 from position 201).

In FIGS. 4(*c*) and 4(*d*), there is shown another embodiment of magnetic implant 20 and corresponding magnetic spacer 50, where only north magnetic poles are employed in magnetic members 60*a*, 60*b*, and 60*c* of magnetic implant 20, and where only south magnetic poles are employed in magnetic members 55*a* and 55*b* of magnetic spacer 50. Such a configuration permits magnetic spacer 50 of FIG. 4(*d*) to assume position 201, position 202, or position 203 with respect to magnetic implant 20 of FIG. 4(*c*). After magnetic implant 20 has been implanted beneath patient's skin 75 and affixed to skull 70, the patient or health care provider can position magnetic spacer 50 in position 201, 202 or 203 by merely lifting magnetic spacer away from patient's skull 70 and repositioning magnetic spacer 50 in the desired different position.

In other words, and continuing to refer to FIGS. 4(*a*) through 4(*d*), such embodiments provide an adjustable magnetic hearing system comprising electromagnetic ("EM") transducer 25, magnetic spacer 50 comprising at least first and second magnetic members 55*a* and 55*b* (where magnetic spacer 50 is configured to be mechanically and acoustically coupled to EM transducer 25), and magnetic implant 20 comprising at least third, fourth and fifth magnetic members 60*a*, 60*b* and 60*c*, respectively. Magnetic implant 20 is configured for implantation beneath patient's skin 75 and affixation to patient's skull 70. Magnetic implant 20 and magnetic spacer 50 are further configured such that the patient or a healthcare provider may selectively position magnetic spacer 50 in at least first position 201 or second position 202 with respect to magnetic implant 20 after magnetic implant 20 has been implanted in the patient. The first position 201 is different from the second position 202, and the first and second magnetic members 55*a* and 55*b* may be magnetically coupled to the third and fourth magnetic members 60*a* and 60*b* when in the first position 201 such that magnetic spacer 50 is operably held in first position 201 against the patient's skin 75. The first and second magnetic members 55*a* and 55*b* may also, however, be magnetically coupled to the fourth and fifth magnetic members 60*a* and 60*b* when in the second position 202 such that magnetic spacer 50 is operably held in the second position against the patient's skin. In the embodiment shown in FIGS. 4(*c*) and 4(*d*), and as described above, a third position 203 is also available to be selected by the patient or health care provider.

It will now be seen that the embodiments of FIGS. 4(*a*) through 4(*d*) permit hearing aid 10 to be positioned in at least first and second positions, and in one embodiment an additional third position 203, on the patient's skull. This provides the patient or health care provider with a means for decreasing and mitigating pain, soreness or irritation caused by hearing aid 10 that might otherwise arise from hearing air 10 being located in one fixed position only, while nevertheless maintaining a required amount of magnetic force to hold hearing aid 10 against the patient's hair or skin 75 while hearing aid 10 is in actual use.

In the embodiment illustrated in FIGS. 4(*a*) and 4(*b*), a beneficial effect with respect to increased magnetic pull force can be realized owing to magnetic flux lines constructively interfering with one another by virtue of such flux lines being additive. This is because adjoining magnetic members in magnetic implant 20 and magnetic spacer 50 in FIGS. 4(*a*) and 4(*b*) are of opposite magnetic poles.

This is not the case, however, with respect to the embodiment shown in FIGS. 4(*c*) and 4(*d*), where such constructive interference of magnetic flux lines does not occur owing to adjoining magnetic members 60*a*, 60*b* and 60*c* of magnetic implant 20 in FIG. 4(*c*) all having the same magnetic pole (in this case a north pole), and adjoining magnetic members 55*a* and 55*b* of magnetic spacer 50 in FIG. 4(*d*) all having the same magnetic pole (in this case a south pole). Note that magnetic implant 20 and magnetic spacer 50 may alternatively be configured so that magnetic members 60*a*, 60*b* and 60(*c*) all have south magnetic poles, and magnetic members 55*a* and 55*b* both have north magnetic poles.

Moreover, and referring now to FIGS. 4(*a*) and 4(*b*), different combinations of north and south magnetic poles may be employed in magnetic members 60*a*, 60*b*, 60*c*, 55*a* and 55*b* other than those shown in the FIGS. 4(*a*) and 4(*b*), as those skilled in the art will now appreciate after having the reviewed and understood the present specification and drawings.

Referring now to FIGS. 5(*a*) through 5(*f*), there are shown various embodiments of magnetic implants 20 and magnetic spacers 50 that are also configured to permit multiple different positions of spacer 50 (and hearing aid 10 attached thereto) to be achieved on a patient's skull 70 by the patient or a health care provider.

In FIGS. 5(*a*), 5(*b*) and 5(*c*), there are shown various embodiments of magnetic implant 20 (FIG. 5(*a*)) and corresponding magnetic spacers 50 (FIGS. 5(*b*) and 5(*c*)), where both north and south magnetic poles are employed in magnetic members 60*a* (north pole), 60*b* (south pole), 60*c* (south pole), and 60*d* of magnetic implant 20 (FIG. 5(*a*)), and where both north and south magnetic poles are employed in magnetic members 55*a* (north pole) and 55*b* (south pole) of magnetic spacers 50 (FIGS. 5(*b*) and 5(*c*)). Such configurations permit magnetic spacer 50 of FIG. 5(*b*) to assume position 203 or position 202 with respect to magnetic implant 20 of FIG. 5(*a*), and magnetic spacer 50 of FIG. 5(*c*) to assume position 201 or position 204 with respect to magnetic implant 20 of FIG. 5(*a*). After magnetic implant 20 has been implanted beneath patient's skin 75 and affixed to skull 70, the patient or health care provider can position magnetic spacer 50 of FIG. 5(*b*) in either position 203 or 202 by merely lifting magnetic spacer away from patient's skull 70 and repositioning magnetic spacer 50 in the desired different position (i.e., position 203 from position 202, or position 202 from position 201). Alternatively, and after magnetic implant 20 has been implanted beneath patient's skin 75 and affixed to skull 70, the patient or health care provider can position magnetic spacer 50 of FIG. 5(*c*) in either position 201 or 204 by merely lifting magnetic spacer away from patient's skull 70 and repositioning magnetic spacer 50 in the desired different position (i.e., position 201 from position 204, or position 204 from position 201).

Note that the distance or spacing between magnetic members in magnetic implant 20 of FIG. 5(*a*) is set at either D1 or D2, and that magnetic spacers 50 of FIGS. 5(*b*) and 5(*c*) have distances between magnetic members of either D1 (FIG. 5(*b*) or D2 (FIG. 5(*c*)). Consequently, different magnetic spacers 50 having different distances between magnetic members may be employed to magnetically couple hearing aid 10 to magnetic implant 20, which in some cases may provide the patient or health care provider with increased options for reducing the pain, soreness or irritation described above. Note that the distances between the magnetic members shown in FIGS. 5(*a*), 5(*b*) and 5(*c*) may also be set to be the same.

In FIGS. 5(*d*), 5(*e*) and 5(*f*), there are shown various embodiments of magnetic implant 20 (FIG. 5(*d*)) and corresponding magnetic spacers 50 (FIGS. 5(*e*) and 5(*f*)), where only south magnetic poles are employed in magnetic members 60*a*, 60*b*, 60*c* and 60*d* of magnetic implant 20, and where only north magnetic poles are employed in magnetic members 55*a* and 55*b* of magnetic spacers 50 of FIGS. 5(*e*) and 5(*f*). Such configurations permit magnetic spacers 50 of FIGS. 5(*e*) and 5(*f*) to assume any of positions 201, 202, 203 or 204 with respect to magnetic implant 20 of FIG. 4(*c*). After magnetic implant 20 has been implanted beneath patient's skin 75 and affixed to skull 70, the patient or health care provider can position magnetic spacer 50 in any of positions 201, 202, 203 or 204 by merely lifting magnetic spacer away from patient's skull 70 and repositioning magnetic spacer 50 in the desired different position.

In other words, and continuing to refer to FIGS. 5(*a*) through 5(*f*), such embodiments provide an adjustable magnetic hearing system comprising electromagnetic ("EM") transducer 25, magnetic spacer 50 comprising at least first and second magnetic members 55*a* and 55*b* (where magnetic spacer 50 is configured to be mechanically and acoustically coupled to EM transducer 25), and magnetic implant 20 comprising at least third, fourth, fifth and sixth magnetic members 60*a*, 60*b*, 60*c* and 60*d*, respectively. Magnetic implant 20 is configured for implantation beneath patient's skin 75 and affixation to patient's skull 70. Magnetic implant 20 and magnetic spacers 50 of FIGS. 5(*a*), 5(*b*) through 5(*f*), are further configured such that the patient or a healthcare provider may selectively position magnetic spacer 50 in at least positions 201, 202, 203 or 204 with respect to magnetic implant 20 after magnetic implant 20 has been implanted in the patient. Positions 201, 202, 203 and 204 are all different from one another. Magnetic members 55*a* and 55*b* may be magnetically coupled to corresponding magnetic members 60*a*, 60*b*, 60*c*, or 60*d* such that magnetic spacer 50 is operably held in the desired positions 201, 202, 203 or 204 against the patient's skin 75.

It will now be seen that the embodiments of FIGS. 5(*a*) through 5(*f*) permit hearing aid 10 to be positioned in four different positions. This provides the patient or health care provider with a means for decreasing and mitigating pain, soreness or irritation caused by hearing aid 10 that might otherwise arise from hearing air 10 being located in one fixed position only, while nevertheless maintaining a required amount of magnetic force to hold hearing aid 10 against the patient's hair or skin 75 while hearing aid 10 is in actual use.

As in FIGS. 4(*a*) and 4(*b*), a beneficial effect with respect to increased magnetic pull force can be realized owing to magnetic flux lines constructively interfering with one another by virtue of such flux lines being additive in the embodiments illustrated in FIGS. 5(*a*) through 5(*c*). This is because adjoining magnetic members in magnetic implant 20 of FIG. 5(*a*) and magnetic spacer 50*s* in FIGS. 5(*b*) and 5(*c*) are of opposite poles.

Such is not the case, however, with respect to the embodiments shown in FIGS. 5(*e*) through 5(*f*), where such constructive interference of magnetic flux lines does not occur owing to adjoining magnetic members 60*a*, 60*b*, 60*c* and 60*d* of magnetic implant 20 in FIG. 5(*d*) all having the same magnetic pole (in this case a south pole), and adjoining magnetic members 55*a* and 55*b* of magnetic spacers 50 in FIGS. 5(*e*) and 5(*f*) all having the same magnetic pole (in this case a north pole). Note that magnetic implant 20 and magnetic spacers 50 may alternatively be configured so that magnetic members 60*a*, 60*b*, 60*c* and 60*d* all have north magnetic poles, and magnetic members 55*a* and 55*b* both have south magnetic poles.

Moreover, and referring to FIGS. 5(*a*) through 5(*c*), different combinations of north and south magnetic poles may be employed in magnetic members 60*a*, 60*b*, 60*c*, 60*d*, 55*a* and 55*b* other than those shown in the FIGS. 5(*a*) through 5(*c*), as those skilled in the art will now appreciate after having the reviewed and understood the present specification and drawings.

Referring now to FIGS. 6(*a*) through 6(*f*), there are shown various additional embodiments of magnetic implants 20 and magnetic spacers 50 that are also configured to permit multiple different positions of spacer 50 (and hearing aid 10 attached thereto) to be selected on a patient's skull 70 by the patient or a health care provider.

In FIGS. 6(*a*), 6(*b*) and 6(*c*), there are shown various embodiments of magnetic implant 20 (FIG. 6(*a*)) and corresponding magnetic spacers 50 (FIGS. 6(*b*) and 6(*c*)), where both north and south magnetic poles are employed in magnetic members 60*a* (south pole), 60*b* (south pole), 60*c* (south pole), 60*d* (south pole) and 60*e* (north pole) of magnetic implant 20 (FIG. 5(*a*)), and where both north and south magnetic poles are employed in magnetic members 55*a* (north pole) and 55*b* (south pole) of magnetic spacers 50 (FIGS. 6(*b*) and 6(*c*)). Such configurations permit magnetic spacer 50 of FIG. 6(*b*) to assume any of positions 201, 202, 203 or 204 with respect to magnetic implant 20 of FIG. 6(*a*), and magnetic spacer 50 of FIG. 6(*c*) to assume any of combined positions 201/204, 204/203, 203/202 or 202/201 respect to magnetic implant 20 of FIG. 6(*a*). After magnetic implant 20 has been implanted beneath patient's skin 75 and affixed to skull 70, the patient or health care provider can position magnetic spacer 50 of FIG. 5(*b*) in any of four different positions 201, 202, 203 or 204 by merely lifting magnetic spacer away from patient's skull 70 and repositioning magnetic spacer 50 in the desired different position. Alternatively, and after magnetic implant 20 has been implanted beneath patient's skin 75 and affixed to skull 70, the patient or health care provider can position magnetic spacer 50 of FIG. 6(*c*) in any of four different combined positions 201/204, 204/203, 203/202 or 202/201 by merely lifting magnetic spacer 50 away from patient's skull 70 and repositioning magnetic spacer 50 in the desired different position.

Note that relative to magnetic spacer 50 of FIG. 6(*b*), magnetic spacer 50 of FIG. 6(*c*) can be configured to provide either increased magnetic coupling force to magnetic implant 20, or to spread the same or substantially the same magnetic coupling force provided by magnetic spacer 50 of FIG. 6(*b*) over a larger surface area that is covered by the three magnetic members 55*a*, 55*b* and 55*c* instead of the two magnetic members 55*a* and 55*b* in magnetic spacer 50 of FIG. 6(*b*). A magnetic spacer 50 with four or five magnetic members may also be provided to operate in conjunction with magnetic implant 20 of FIG. 6(*a*).

Note that the distance or spacing between magnetic members in magnetic implant 20 of FIG. 6(*a*) is set at D1, and that magnetic spacers 50 of FIGS. 6(*b*) and 6(*c*) also have distances between magnetic members of D1. As in the embodiments described above relating to FIGS. 6(*a*) through 6(*c*), however, magnetic spacers 50 having different distances between magnetic members may also be employed to magnetically couple hearing aid 10 to magnetic implant 20, which may also be configured correspondingly to have magnetic members of different spacings.

In FIGS. 6(*d*), 6(*e*) and 6(*f*), there are shown various embodiments of magnetic implant 20 (FIG. 6(*d*)) and corresponding magnetic spacers 50 (FIGS. 6(*e*) and 6(*f*)), where only north magnetic poles are employed in magnetic members 60*a*, 60*b*, 60*c*, 60*d* and 60*e* of magnetic implant 20, and where only south magnetic poles are employed in magnetic members 55*a*, 55*b* and 55*c* of magnetic spacers 50 in FIGS. 6(*e*) and 6(*f*). Such configurations permit magnetic spacer 50 of FIG. 6(*e*) to assume any of positions 201, 202, 203 or 204 with respect to magnetic implant 20 of FIG. 6(*d*), and magnetic spacer 50 of FIG. 6(*f*) to assume any of combined positions 201/204, 204/203, 203/202 or 202/201 with respect to magnetic implant 20 of FIG. 6(*d*). After magnetic implant 20 has been implanted beneath patient's skin 75 and affixed to skull 70, the patient or health care provider can position magnetic spacer 50 of FIG. 6(*e*) in any of positions 201, 202, 203 or 204 by merely lifting magnetic spacer away from patient's skull 70 and repositioning magnetic spacer 50 in the desired different position. Alternatively, and after magnetic implant 20 has been implanted beneath patient's skin 75 and affixed to skull 70, the patient or health care provider can position magnetic spacer 50 of FIG. 6(*c*) in any of four different combined positions 201/204, 204/203, 203/202 or 202/201 by merely lifting magnetic spacer 50 away from patient's skull 70 and repositioning magnetic spacer 50 in the desired different position.

In other words, and continuing to refer to FIGS. 6(*a*) through 6(*f*), such embodiments provide an adjustable magnetic hearing system comprising electromagnetic ("EM") transducer 25, magnetic spacer 50 comprising at least first and second magnetic members 55*a* and 55*b* (where magnetic spacer 50 is configured to be mechanically and acoustically coupled to EM transducer 25), and magnetic implant 20 comprising at least third, fourth, fifth, sixth and seventh magnetic members 60*a*, 60*b*, 60*c*, 60*d* and 60*e*, respectively. It will now be seen that the embodiments of FIGS. 6(*a*) through 6(*f*) permit hearing aid 10 to be positioned in four different positions. This provides the patient or health care provider with a means for decreasing and mitigating pain, soreness or irritation caused by hearing aid 10 that might otherwise arise from hearing air 10 being located in one fixed position only, while nevertheless maintaining a required amount of magnetic force to hold hearing aid 10 against the patient's hair or skin 75 while hearing aid 10 is in actual use.

As in FIGS. 4(*a*) and 4(*b*), and as in FIGS. 5(*a*) through 5(*c*), a beneficial effect with respect to increased magnetic pull force can be realized owing to magnetic flux lines constructively interfering with one another by virtue of such flux lines being additive in the embodiments illustrated in FIGS. 6(*a*) through 6(*c*). This is because adjoining magnetic members in magnetic implant 20 and magnetic spacer 50 in FIGS. 6(*a*) through 6(*c*) are of opposite poles.

This is not the case, however, with respect to the embodiments shown in FIGS. 6(*e*) through 6(*f*), where such constructive interference of magnetic flux lines does not occur owing to adjoining magnetic members 60*a*, 60*b*, 60*c*, 60*d* and 60*e* of magnetic implant 20 in FIG. 6(*d*) all having the same magnetic pole (in this case north), and adjoining magnetic members 55*a*, 55*b* and 55*c* of magnetic spacers 50 in FIGS. 6(*e*) and 6(*f*) all having the same magnetic pole (in this case south). Note that magnetic implant 20 and magnetic spacers 50 may alternatively be configured so that magnetic members 60*a*, 60*b*, 60*c*, 60*d* and 60*e* all have south magnetic poles, and magnetic members 55*a*, 55*b* and 55*c* all have north magnetic poles.

Moreover, and referring to FIGS. 6(*a*) through 6(*c*), different combinations of north and south magnetic poles may be employed in magnetic members 60*a*, 60*b*, 60*c*, 60*d*, 60*e*, 55*a*, 55*b* and 55*c* other than those shown in the FIGS. 6(*a*) through 6(*c*), as those skilled in the art will now appreciate after having the reviewed and understood the present specification and drawings.

Referring now to FIGS. 7(*a*) through 7(*h*), there are shown various further embodiments of magnetic implants 20 and magnetic spacers 50 that are also configured to permit multiple different positions of spacer 50 (and hearing aid 10 attached thereto) to be selected on a patient's skull 70 by the patient or a health care provider.

In FIGS. 7(*a*) through 7(*d*), there are shown various embodiments of magnetic implant 20 (FIG. 7(*a*)) and corresponding magnetic spacers 50 (FIGS. 7(*b*), 7(*c*) and 7(*d*)), where both north and south magnetic poles are employed in magnetic members 60*a* (south pole), 60*b* (north pole), 60*c* (south pole), 60*d* (north pole), 60*e* (south pole) and 60*f* (north pole) of magnetic implant 20 (FIG. 7(*a*)), and where both north and south magnetic poles are employed in magnetic members 55*a* (north pole), 55*b* (south pole) and 55*c* (north pole) of magnetic spacers 50 (FIGS. 7(*b*), 7(*c*) and 7(*d*)). Such configurations permit magnetic spacer 50 of FIG. 7(*b*) to assume any of positions 207, 208 or 209 with respect to magnetic implant 20 of FIG. 7(*a*), magnetic spacer 50 of FIG. 7(*c*) to assume any of positions 201, 202, 203, 204, 205 or 206 with respect to magnetic implant 20 of FIG. 7(*a*), and magnetic spacer 50 of FIG. 7(*d*) to assume any of combined positions 201/206, 206/205, 205/204, 204/203, 203/202, and 202/201 with respect to magnetic implant 20 of FIG. 6(*a*). Thus, after magnetic implant 20 has been implanted beneath patient's skin 75 and affixed to skull 70, the patient or health care provider can position magnetic spacer 50 of FIG. 7(*b*) in any of three different positions 207, 208 or 209 by merely lifting magnetic spacer away from patient's skull 70 and repositioning magnetic spacer 50 in the desired different position. Alternatively, and after magnetic implant 20 has been implanted beneath patient's skin 75 and affixed to skull 70, the patient or health care provider can position magnetic spacer 50 of FIG. 7(*c*) in any of six different positions 201, 202, 203, 204, 205 or 206 by merely lifting magnetic spacer 50 away from patient's skull 70 and repositioning magnetic spacer 50 in the desired different position. In addition, and after magnetic implant 20 has been implanted beneath patient's skin 75 and affixed to skull 70, the patient or health care provider can position magnetic spacer 50 of FIG. 7(*d*) in any of six different combined positions 201/206, 206/205, 205/204, 204/203, 203/202, and 202/201 by merely lifting magnetic spacer 50 away from patient's skull 70 and repositioning magnetic spacer 50 in the desired different position.

Note that relative to magnetic spacer 50 of FIG. 7(*c*), magnetic spacers 50 of FIGS. 7(*b*) and 7(*d*) can be configured to provide either increased magnetic coupling force to magnetic implant 20, or to spread the same or substantially the same magnetic coupling force provided by magnetic spacer 50 of FIG. 6(*b*) over a larger surface area. A magnetic spacer 50 with four or five magnetic members may also be provided to operate in conjunction with magnetic implant 20 of FIG. 7(*a*).

Note further that the distance or spacing between magnetic members in magnetic implant 20 of FIG. 6(*a*) is set at both D1 and D2, and that magnetic spacers 50 of FIGS. 7(*b*)

and 7(*c*) have distances between magnetic members of D1 and D2, respectively. Magnetic spacer 50 of FIG. 7(*d*) has distances between magnetic members of D1. Note further that an additional magnetic member 60*g* may be provided at the center of magnetic implant 20 to provide even further different selectable positions for magnetic spacer 50 and hearing aid 10.

In FIGS. 7(*e*) through 7(*h*), there are shown various embodiments of magnetic implant 20 (FIG. 7(*e*)) and corresponding magnetic spacers 50 (FIGS. 7(*f*), 7(*g*) and 7(*h*)), where only south magnetic poles are employed in magnetic members 60*a*, 60*b*, 60*c*, 60*d*, 60*e* and 60*f* of magnetic implant 20, and where only north magnetic poles are employed in magnetic members 55*a*, 55*b* and 55*c* of magnetic spacers 50 in FIGS. 7(*f*), 7(*g*) and 7(*h*). The various positions magnetic spacers 50 of FIGS. 7(*f*) through 7(*h*) may assume with respect to magnetic implant 20 of FIG. 7(*e*) are described in sufficient detail above in connection with FIGS. 7(*a*) through 7(*d*), and need not be repeated here.

In other words, and continuing to refer to FIGS. 7(*a*) through 7(*h*), the embodiments shown in FIGS. 7(*a*) through 7(*h*) provide an adjustable magnetic hearing system comprising electromagnetic ("EM") transducer 25, magnetic spacer 50 comprising at least first and second magnetic members 55*a* and 55*b* (where magnetic spacer 50 is configured to be mechanically and acoustically coupled to EM transducer 25), and magnetic implant 20 comprising at least third, fourth, fifth, sixth, seventh and eighth magnetic members 60*a*, 60*b*, 60*c*, 60*d*, 60*e* and 60*f*, respectively. It will now be seen that the embodiments of FIGS. 7(*a*) through 7(*h*) permit hearing aid 10 to be positioned in nine different positions. An additional six positions can be provided by including an additional magnetic member 60*g* (not shown in the drawings) at the center of magnetic implant 20 of FIGS. 7(*a*) and 7(*e*). This provides the patient or health care provider with a means for decreasing and mitigating pain, soreness or irritation caused by hearing aid 10 that might otherwise arise from hearing air 10 being located in one fixed position only, while nevertheless maintaining a required amount of magnetic force to hold hearing aid 10 against the patient's hair or skin 75 while hearing aid 10 is in actual use.

Note that different combinations of north and south magnetic poles may be employed in magnetic members 60*a*, 60*b*, 60*c*, 60*d*, 60*e*, 60*f*, 60*g*, 55*a*, 55*b* and 55*c* other than those shown in the FIGS. 7(*a*) through 7(*h*), as those skilled in the art will now appreciate after having the reviewed and understood the present specification and drawings.

In FIGS. 8(*a*) through 8(*c*), there are shown various embodiments of magnetic implant 20 (FIG. 8(*a*)) and corresponding magnetic spacers 50 (FIGS. 8(*b*) and 8(*c*)), where both north and south magnetic poles are employed in magnetic members 60*a* (north pole), 60*b* (south pole), 60*c* (north pole), 60*d* (south pole), 60*e* (north pole) and 60*f* (south pole) of magnetic implant 20 (FIG. 8(*a*)), and where both north and south magnetic poles are employed in magnetic members 55*a* (north pole), 55*b* (south pole) and 55*c* (south pole) of magnetic spacers 50 (FIGS. 8(*b*) and 8(*c*)). Such configurations permit magnetic spacer 50 of FIG. 8(*b*) to assume any of positions 201, 202, 203, 204, 205 or 206 with respect to magnetic implant 20 of FIG. 8(*a*), and magnetic spacer 50 of FIG. 8(*c*) to assume either of combined positions 204/205 and 203/206 with respect to magnetic implant 20 of FIG. 8(*a*).

Note that relative to magnetic spacer 50 of FIG. 8(*b*), magnetic spacer 50 of FIG. 8(*c*) can be configured to provide either increased magnetic coupling force to magnetic implant 20, or to spread the same or substantially the same magnetic coupling force provided by magnetic spacer 50 of FIG. 8(*b*) over a larger surface area. A magnetic spacer 50 with four or five magnetic members may also be provided to operate in conjunction with magnetic implant 20 of FIG. 8(*a*). Alternatively, or in addition, different combinations of north and south magnetic poles are contemplated other than those shown in FIGS. 8(*a*) and 8(*c*).

Note further that the distance or spacing between magnetic members in magnetic implant 20 of FIG. 8(*a*) is set at D1, and that magnetic spacers 50 of FIGS. 8(*b*) and 8(*c*) also have distances between magnetic members of D1. Magnetic spacers 50 having different distances between magnetic members may also be employed to magnetically couple hearing aid 10 to magnetic implant 20, which may also be configured correspondingly to have magnetic members of different spacings.

In FIGS. 8(*d*) through 8(*h*), there are shown various embodiments of magnetic implant 20 (FIG. 8(*d*)) and corresponding magnetic spacers 50 (FIGS. 8(*e*) and 8(*f*)), where only north magnetic poles are employed in magnetic members 60*a*, 60*b*, 60*c*, 60*d*, 60*e* and 60*f* of magnetic implant 20, and where only south magnetic poles are employed in magnetic members 55*a*, 55*b* and 55*c* of magnetic spacers 50 in FIGS. 8(*e*) and 8(*f*). The various positions that magnetic spacers 50 of FIGS. 8(*e*) and 8(*f*) may assume with respect to magnetic implant 20 of FIG. 8(*d*) are described in sufficient detail above in connection with FIGS. 8(*a*) through 8(*c*), although it is to be noted that at least one additional combined position 202/207 is provided by the embodiments shown in FIGS. 8(*d*) and 8(*f*) than those corresponding to FIGS. 8(*a*) and 8(*c*). The embodiments shown in FIGS. 8(*a*) through 8(*f*) provide a patient or health care provider with a means for decreasing and mitigating pain, soreness or irritation caused by hearing aid 10 that might otherwise arise from hearing air 10 being located in one fixed position only, while nevertheless maintaining a required amount of magnetic force to hold hearing aid 10 against the patient's hair or skin 75 while hearing aid 10 is in actual use.

Note that different combinations of north and south magnetic poles may be employed in magnetic members 60*a*, 60*b*, 60*c*, 60*d*, 60*e*, 60*f*, 55*a*, 55*b* and 55*c* other than those shown in the FIGS. 8(*a*) through 8(*f*), as those skilled in the art will now appreciate after having the reviewed and understood the present specification and drawings.

Figure 9B:
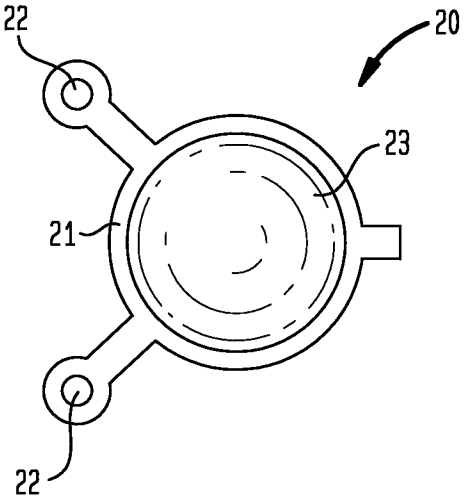
FIG. 9(*a*) shows a side view of a portion of one embodiment of magnetic implant 20.
Figure 9A:
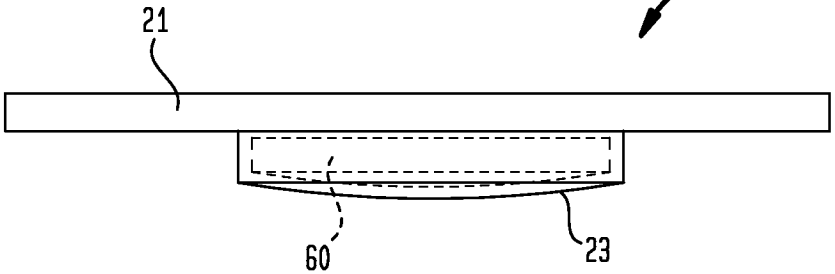

FIGS. 9(*a*) and 9(*b*) show side and top plan views, respectively, of one embodiment of a portion of magnetic implant 20 comprising frame 21, magnetic member 60, and hermetically sealed metal cover 23, which is disposed over and covers magnetic member 60. According to one embodiment, hermetically sealed metal cover 23 is laser-welded over magnetic member 60 thereby to seal magnetic member 60 within frame 21 and prevent the ingress of biological and potentially corrosive fluids into or around magnetic member 60.

Figure 10A:
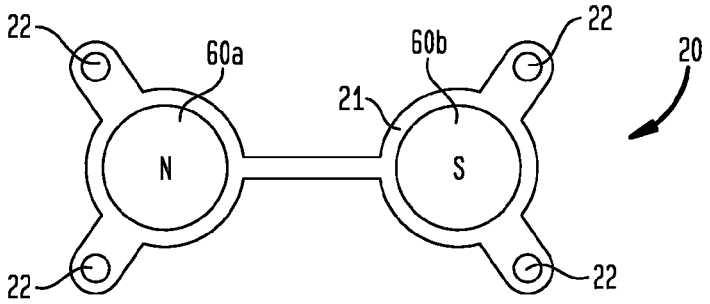
FIG. 10(*a*) shows one embodiment of magnetic implant 20.
Figure 10B:
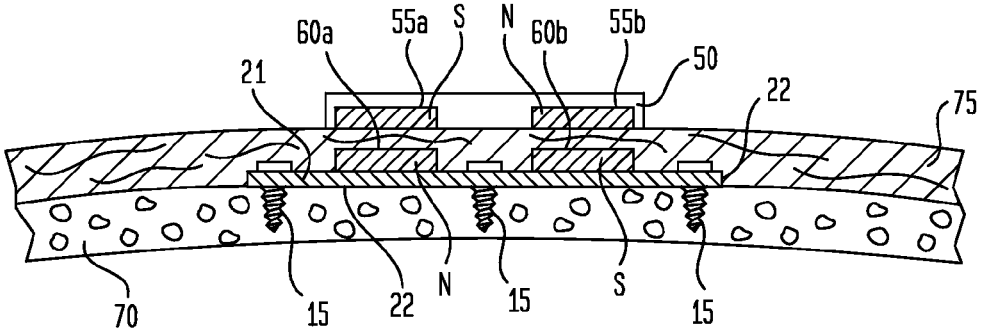
Figure 10C:
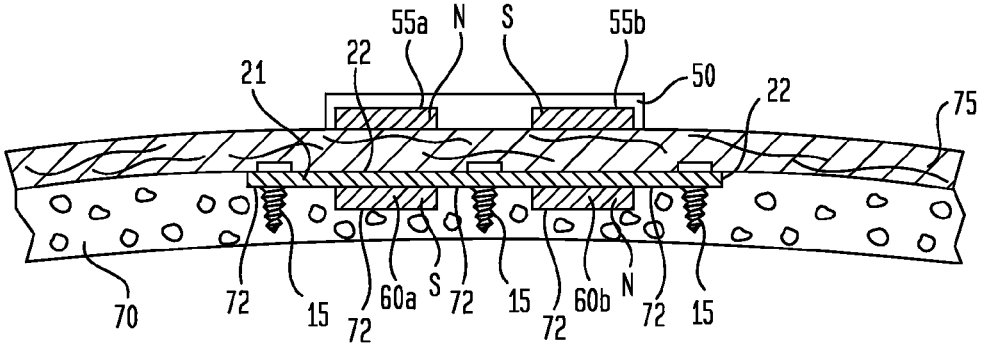

FIG. 10(*a*) shows one embodiment of magnetic implant 20 with magnetic members 60*a* and 60*b* affixed to or mounted on frame 21. FIGS. 10(*a*) and 10(*b*) show two different embodiments of side cross-sectional views of magnetic implant 20 of FIG. 10(*a*) affixed to skull 75 of a patient. In FIG. 10(*b*), one embodiment of magnetic implant 20 is shown with frame 21 disposed and mounted atop the bone of skull 75, where skull 75 is not drilled into or otherwise shaped to receive magnetic members 60*a* or 60*b*, or frame 21, therein. In FIG. 10(*b*), bone screws 15 secure or affix frame 21 to skull 70 such that the bottom side of frame 21 engages and lies next to the outer bony surface of skull 70.

FIG. 10(*c*) shows an alternative means and method of affixing frame 21 to skull 70, where outer portions 72 of the bone of skull 70 have been mechanically removed by drilling, chipping or other suitable means so that portions of frame 21 and magnetic members 60*a* and 60*b* are received in the recesses of skull 70 formed by such removal. In such an embodiment, the thickness of skin 75 overlying magnetic implant 20 is increased, with the objective of reducing the potential for pain, soreness or irritation occurring through chronic wearing of hearing aid 10 and magnetic spacer 50 over magnetic implant 20. As magnetic spacer 50 has rotational freedom, the system of adhesion and function of device 10 still works as intended in the embodiment illustrated in FIG. 10(*b*).

According to some embodiments, magnets 60 are substantially disc-shaped, although other shapes are contemplated. Illustrative diameters of such magnets 60 can range, by way of non-limiting example, between about 8 mm and about 20 mm, and can have thicknesses ranging between about 1 mm and about 4 mm. The center-to-center spacing of magnets 60 in frame 21 may range, by way of non-limiting example, between about 1.5 cm and about 2.5 cm, with a preferred spacing of about 2 cm. As described above, rare earth magnets that provide high magnetic force are preferred for magnets 60. A system adhesion force, or magnetic pull or coupling force, accomplished with two implanted magnets 60*a* and 60*b* and a corresponding pair of external magnets 55*a* and 55*b* located in magnetic spacer 50 may range, by way of non-limiting example, between about 0.5 Newtons and about 3 Newtons, with a preferred range of 1 Newton to 2.5 Newtons. Variability in adhesion force can be accomplished solely with different base plate or magnetic spacer 50 configurations (as described above), while implanted magnets 60*a*, 60*b*, 60*c*, etc., have a fixed adhesion force associated therewith once they have been implanted.

Those skilled in the art will now understand that many different permutations, combinations and variations of implant array 20 fall within the scope of the various embodiments. For example, 2, 3, 4, 5, 6, 7, 8, 9 or more magnets 60 may be employed in frame 22. Frame 22 may be configured in star-shaped, hexagonally-shaped, pentagonally-shaped, triangle-shaped, rectangularly-shaped, and many other geometric configurations. Magnets 60 may also be enclosed within frame 22 by laser welding, for example, as described above.

Note further that magnetic members 55*a* and 55*b* in FIGS. 3(*b*) and 3(*c*), and magnetic members 60*a* and 60*b* shown in FIG. 3(*a*), may feature increased and larger surface areas with respect to the prior art so as to reduce patient pain, soreness and irritation. Examples of diameters of magnetic members 55*a*, 55*b*, 60*a* and 60*b* having such increased surface area with respect to prior art devices include, but are not limited to, magnetic members having diameters exceeding about 0.6 inches, exceeding about 0.7 inches, exceeding about 0.8 inches, and exceeding about 0.9 inches.

The corresponding thicknesses of magnetic members 55*a*, 55*b*, 60*a* and 60*b* in such increased diameter magnetic members may also be reduced with respect to prior art magnetic members while maintaining equivalent magnetic pull forces. Examples of the thicknesses of magnetic members 55*a*, 55*b*, 60*a* and 60*b* having such decreased thicknesses with respect to prior art devices include, but are not limited to, magnetic members having thicknesses less than about 2 mm, less than about 3 mm, less than about 4 mm, less than about 5 mm, and less than about 6 mm. Note further that magnetic members having increased surface areas and/or decreased thicknesses are contemplated in all of the embodiments of magnetic implants 20 and magnetic spacers 50 disclosed herein.

Referring now to FIGS. 4(*a*) through 10(*c*), the various magnetic members 55 and 60 disclosed and shown herein may be disc-shaped, and according to some embodiments may each comprise a rare earth magnetic material such as neodymium. Suppliers of suitable magnetic members include K&J Magnetics of Jamison, Pa. and Schallenkammer Magnetsysteme of Rimpar, Germany.

In yet other embodiments, there may be provided methods of adjusting positions of magnetic hearing device 10 on a patient's head with respect to magnetic implant 20 comprising a patient or healthcare provider selectively positioning magnetic spacer 50 in a first position or in a second position with respect to magnetic implant 20 after magnetic implant 20 has been implanted in the patient. According to the embodiments of magnetic spacer 50 and magnetic implant that are employed, the patient or healthcare provider may also selectively position magnetic spacer 50 in one or more of a third position, fourth position, fifth position, sixth, position, seventh position, eighth position, or other additional position with respect to magnetic implant 20 after the magnetic implant has been implanted in the patient. Different magnetic spacers 50 having different numbers of magnetic members and/or magnetic members having different center-to-center spacings may also be employed in conjunction with one or more magnetic implants 20.

Those skilled in the art will now appreciate that many different combinations, permutations and configurations of magnetic spacers, magnetic implants, magnetic members, center-to-center spacings of magnetic members, magnetic pole orientations, and magnetic adhesion or pull forces may be employed to arrive at a suitable adjustable magnetic bone conduction hearing aid that may be positioned by a patient or health care provider in multiple orientations or locations on the patient's skull.

Figure 11A:
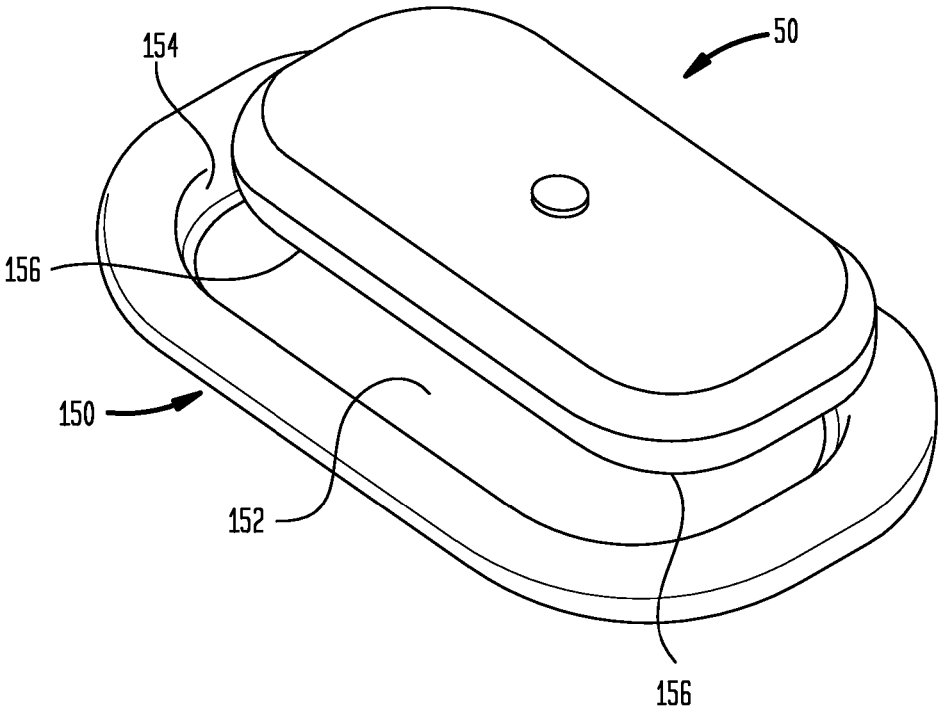
Figure 11B:
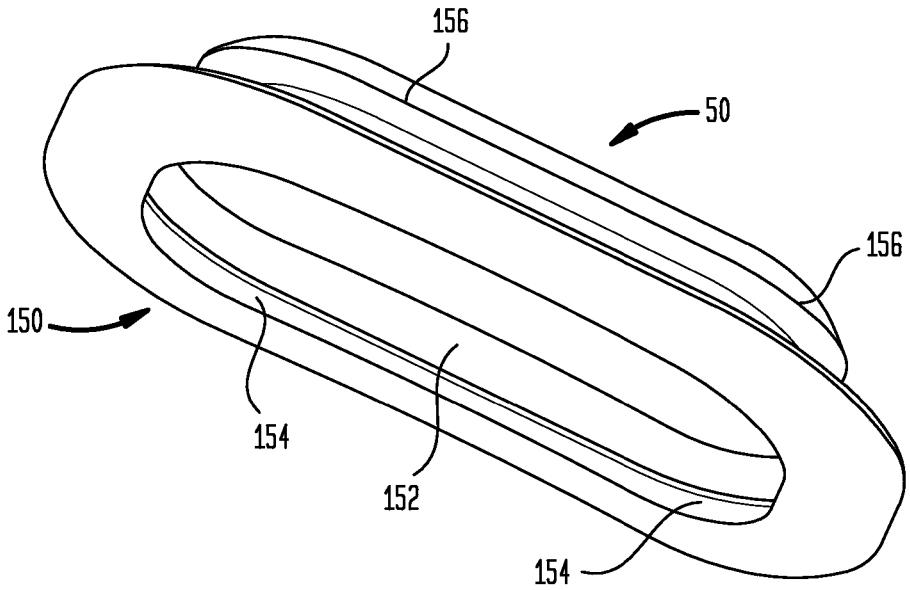

Finally, and referring now to FIGS. 11(*a*) and 11(*b*), there are shown two different views of one embodiment of a force-spreading or force-distributing supplemental spacer 150 configured for use with magnetic spacer 50. FIG. 11(*a*) shows a top left perspective view of magnetic spacer 50 positioned above supplemental spacer 150, while FIG. 11(*b*) shows a bottom right perspective view of magnetic spacer 50 positioned above supplemental spacer 150. Edges 156 disposed about the bottom periphery of magnetic spacer 50 are configured to fit conformably with corresponding edges 154 disposed about an inner periphery of supplemental spacer 150 such that spacer 50 fits within recess 152 of additional spacer 150.

In one embodiment, supplemental spacer 150 comprises a pliable relatively soft material that is capable of compressing slightly and spreading out over a patient's skull surface or hair when magnetic spacer and supplemental spacer 150 are placed in operable relation over magnetic implant 20 affixed to patient's skull 70. As a result, supplemental spacer 150 provides yet another means for changing the pressure points on a patient's skin 75 that result from the operable magnetic coupling of magnetic spacer 50 to magnetic implant 20 and patient's skull 70.

Different widths and thicknesses of supplemental spacer 150 may be employed to more widely or more narrowly spread out or distribute the coupling forces between spacer 50 and magnetic implant 20. Materials from which supplemental spacer 150 may be formed include, but are not limited to, suitable plastics, polymers, gels encased in suitable polymers or plastics, and the like.

Continuing to refer to FIGS. 11(*a*) and 11(*b*), supplemental spacer 150 is configured for use in conjunction with magnetic spacer 50 in a magnetic hearing system comprising electromagnetic ("EM") transducer 25, magnetic spacer 50, and magnetic implant 20. Magnetic spacer 50 comprises at least a first magnetic or ferrous member 50 is configured to be mechanically and acoustically coupled to EM transducer 25. Magnetic implant 20 comprises at least a second magnetic or ferrous member 60 and is configured for implantation beneath patient's skin 75 and affixation to patient's skull 70. Magnetic spacer 50 and magnetic implant 20 are configured to magnetically couple to one another through patient's skin 75 and to secure magnetic spacer 50 to patient's skull 70. According to one embodiment, supplemental spacer 150 comprises central recess 152 and inner periphery 154 configured to receive magnetic spacer 50 therein, and to spread out or redistribute magnetic forces acting between magnetic spacer 50 and magnetic implant 20 over patient's skin 75.

The above-described embodiments should be considered as examples of the present invention, rather than as limiting the scope of the invention. In addition to the foregoing embodiments of the invention, review of the detailed description and accompanying drawings will show that there are other embodiments of the present invention. Accordingly, many combinations, permutations, variations and modifications of the foregoing embodiments of the present invention not set forth explicitly herein will nevertheless fall within the scope of the present invention.

We claim:

1. A supplemental spacer for use, in conjunction with a magnetic spacer in a magnetic hearing system comprising an electromagnetic ("EM") transducer, the magnetic spacer, and a magnetic implant, the magnetic spacer comprising at least a first magnetic or ferrous member and being configured to be mechanically and acoustically coupled to the EM transducer, the magnetic implant comprising at least a second magnetic or ferrous member and being configured for implantation beneath a patient's skin and affixation to the patient's skull, the magnetic spacer and magnetic implant being configured to magnetically couple to one another through the patient's skin and to secure the magnetic spacer to the patient's skull, the supplemental spacer comprising a central recess and an inner periphery configured to receive the magnetic spacer therein, the supplemental spacer further being configured to spread out or redistribute forces acting between the magnetic spacer and the magnetic implant over the patient's skin.

2. The supplemental spacer of claim 1, wherein said supplemental spacer comprises a pliable material.

3. The supplemental spacer of claim 2, wherein said, pliable material is capable of compressing and spreading out over said patient's skin.

4. The supplemental spacer of claim 1, wherein said supplemental spacer comprises at least one of a plastic, a polymer, a gel encased in a polymer, or a gel encased in a plastic.

5. The supplemental spacer of claim 1, wherein said supplemental spacer spreads force applied by the magnetic spacer to the patient's skin.

6. The supplemental spacer of claim 1, wherein said supplemental spacer changes pressure points on the patient's skin.

7. The supplemental spacer of claim 1, wherein said magnetic spacer is completely received within said central recess.

8. The supplemental spacer of claim 1, wherein said central recess of said supplemental spacer surrounds said magnetic spacer.

9. A supplemental spacer for use in conjunction with a spacer in a hearing system comprising an electromagnetic ("EM") transducer, the spacer, and a magnetic implant, the spacer comprising at least a first member and being configured to be mechanically and acoustically coupled to the EM transducer, the magnetic implant comprising at least a second magnetic member and being configured for implantation beneath a patient's skin and affixation to the patient's skull, the spacer and magnetic implant being configured to magnetically couple to one another through the patient's skin and to secure the spacer, the spacer is disposed about an inner periphery of the supplemental spacer, the supplemental spacer further being configured to redistribute forces acting between the spacer and the magnetic implant over the patient's skin, wherein said supplemental spacer comprises a pliable material capable of deflecting in contact with the patient's skin.

10. The supplemental spacer of claim 9, wherein said spacer is completely received within a central recess of the supplemental spacer.

11. The supplemental spacer of claim 10, wherein said central recess of said supplemental spacer surrounds said spacer.

12. A hearing aid system including a supplemental spacer for use in conjunction with a spacer, the hearing system comprising an electromagnetic ("EM") transducer, the spacer, and a magnetic implant, the spacer comprising at least a first member and being configured to be mechanically and acoustically coupled to the EM transducer, the magnetic implant comprising at least a second magnetic member and being configured for implantation beneath a patient's skin and affixation to the patient's skull, the spacer and magnetic implant being configured to magnetically couple to one another through the patient's skin and to secure the spacer, the spacer is disposed about an inner periphery of the supplemental spacer, wherein said spacer is completely received within a central recess of the supplemental spacer, said central recess of said supplemental spacer surrounds said spacer, the supplemental spacer further being configured to redistribute forces acting between the spacer and the magnetic implant over the patient's skin, wherein said supplemental spacer comprises a pliable material capable of deflecting in contact with the patient's skin.

13. The system of claim 12 wherein material comprising the supplemental spacer is less rigid than material comprising the spacer.

* * * * *